US006793210B2

(12) United States Patent
Sato

(10) Patent No.: US 6,793,210 B2
(45) Date of Patent: Sep. 21, 2004

(54) FOLDING/STITCHING APPARATUS

(75) Inventor: Shiro Sato, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 217 days.

(21) Appl. No.: 10/153,720

(22) Filed: May 24, 2002

(65) Prior Publication Data

US 2002/0185045 A1 Dec. 12, 2002

(30) Foreign Application Priority Data

Jun. 7, 2001 (JP) ..... P2001-172880
Mar. 26, 2002 (JP) ..... P2002-085592

(51) Int. Cl.[7] ..... B41L 43/12

(52) U.S. Cl. ..... 270/37; 270/52.18; 270/58.08; 493/384; 493/444; 493/445

(58) Field of Search ..... 270/37, 52.18, 270/58.07, 58.08; 493/444, 445, 384

(56) References Cited

U.S. PATENT DOCUMENTS 389,147 A * 9/1888 Heyl ..... 493/384
3,492,955 A * 2/1970 Gallagher ..... 112/21
4,270,742 A * 6/1981 Kobayashi ..... 270/37
4,592,651 A * 6/1986 Oikawa et al. ..... 355/72
4,595,187 A * 6/1986 Bober ..... 270/37
4,735,406 A * 4/1988 Weber ..... 270/52.3
5,342,032 A * 8/1994 Meier ..... 270/37
5,377,965 A * 1/1995 Mandel et al. ..... 270/37
5,461,469 A * 10/1995 Farrell et al. ..... 399/407
6,251,054 B1 * 6/2001 Cruz et al. ..... 493/383
6,554,267 B2 * 4/2003 Trovinger ..... 270/52.18
6,578,838 B2 * 6/2003 Trovinger et al. ..... 270/52.18

FOREIGN PATENT DOCUMENTS

WO WO 00/18583 * 4/2000

* cited by examiner

*Primary Examiner*—Patrick Mackey
(74) *Attorney, Agent, or Firm*—Nath & Associates PLLC; Marvin C. Berkowitz; Derek Richmond

(57) ABSTRACT

A folding/stitching apparatus (1) includes a sheet setting tray (3) having a slit (7), on which a plurality of superimposed sheets (P1) are set, a folding/stitching plate (16) provided to be freely moved between a standby position for not entering the slit (7) of the sheet setting tray (3) and a folding/stitching position for entering the slit (7) and having a staple bending portion (19) provided in an insertion tip into the slit (7), and a stapler (20) pressed into contact through the sheets (P1) with the folding/stitching plate 16 set in a folding/stitching position to stick staples into the sheets (P1). The folding/stitching plate (16) is moved between the standby position and the folding/stitching position in conjunction with an operation of a handle (12).

13 Claims, 21 Drawing Sheets

FOLDING/STITCHING APPARATUS

BACKGROUND OF THE INVENTION

1. Field of the Invention

The present invention relates to a folding/stitching apparatus for folding a plurality of superimposed (laminated) sheets and stitching the sheets in the folded position by staples.

2. Description of the Related Art

FIG. 1 shows one of folding/stitching apparatus that has been proposed. As shown in FIG. 1, a folding/stitching apparatus 100 includes a plurality of paper feed trays 101 disposed in upper and lower directions, on each of which a plurality of superimposed sheets are placed, not-shown paper feed means for feeding the plurality of sheets set on the paper feed trays 101, sheet loading means 102 for conveying and setting the plurality of sheets fed by the paper feed means respectively in stapling and saddle-stitching positions, stapling means 103 for sticking staples (so-called stapling) into the plurality of sheets set in the stapling position by the sheet loading means 102, folding means 104 for folding the plurality of sheets set in the saddle-stitching position by the sheet loading means 102, sheet discharge means 105 for moving the plurality of sheets folded by the folding means 104 in a discharging direction, trimmer means 106 for trimming folded and saddle-stitched sheets P conveyed by the sheet discharge means 105 and a paper receiving tray 107, on which the folded and saddle-stitched sheets P discharged by the trimmer means 106 are placed.

In the above-described constitution, the plurality of sheets set on the paper feed trays 101 are conveyed to the sheet loading means 102 by the paper feed means, and the plurality of sheets are set in the stapling position by the sheet loading means 102. The stapling means 103 sticks staples into the plurality of sheets set in the stapling position, and thus the plurality of sheets are stapled in a desired stapling position to be stitched.

The plurality of sheets are set in a folding position by the sheet loading means 102. The folding means 104 folds the plurality of sheets set in the folding position, and thus the plurality of sheets are folded in the stapling position. The folded and saddle-stitched sheets P are conveyed by the sheet discharge means 105, and guided to the trimmer means 106. After trimming at the trimmer means 106, the sheets P are discharged to the paper receiving tray 107.

However, in the proposed folding/stitching apparatus 100, the stapling position for sticking staples into the sheets by the stapling means 103 and the folding position for folding the sheets by the folding means 104 must be aligned with each other. If positions of both are shifted from each other, sheets P well folded and saddle-stitched cannot be obtained. An alignment unit is necessary in order to obtain well-folded and saddle-stitched sheets P, which has resulted in complexity of a structure and other problems.

SUMMARY OF THE INVENTION

An object of the present invention is to provide a folding/stitching apparatus capable of accurately setting both a folding position and a stitching position. Another object of the present invention is to provide a folding/stitching apparatus having a simple structure.

The first aspect of the present invention provides a folding/stitching apparatus comprising: a sheet setting tray having an upper surface side where the slit is opened and sheets are set; a folding/stitching plate provided to be freely moved between a standby position for not entering the slit of the sheet setting tray and a folding/stitching position for entering the slit, the folding/stitching plate having a staple bending portion provided in an insertion tip into the slit; and a stapler pressed into contact through the sheets with the folding/stitching plate set in a folding/stitching position to stick staples into the sheets.

The second aspect of the present invention provides the folding/stitching apparatus according to the first aspect of this invention, further comprising: a handle to be manually operated, wherein the folding/stitching plate is moved between the standby position and the folding/stitching position in conjunction with an operation of the handle.

The third aspect of the present invention provides the folding/stitching apparatus according to the first aspect of this invention, still further comprising: a motor, wherein the folding/stitching plate is moved between the standby position and the folding/stitching position by a driving force of the motor.

The fourth aspect of the present invention provides the folding/stitching apparatus according to the first aspect of this invention, wherein a pair of introduction rollers is provided in the slit, and the folding/stitching plate is inserted integrally with the sheets between the pair of introduction rollers.

The fifth aspect of the present invention provides the folding/stitching apparatus according to the fourth aspect of this invention, wherein the pair of introduction rollers is freely moved in both a contact direction with each other and a separate direction from each other, and pressed in the contact direction by an urging means.

The sixth aspect of the present invention provides the folding/stitching apparatus according to the fourth aspect of this invention, wherein the folding/stitching plate is moved from the standby position to the folding/stitching position, and then the pair of introduction rollers is rotated in a direction for moving folded sheets integrally.

The seventh aspect of the present invention provides the folding/stitching apparatus according to the sixth aspect of this invention, wherein the folding/stitching plate advances from the standby position to the folding/stitching position, and then the pair of introduction rollers is rotated in conjunction with the operation of the handle.

The eighth aspect of the present invention provides the folding/stitching apparatus according to the sixth aspect of this invention, wherein the pair of introduction rollers is rotated by a driving force of the motor.

The ninth aspect of the present invention provides the folding/stitching apparatus according to the first aspect of this invention, yet further comprising: a sheet lead-out member, wherein the sheet lead-out member guides the folded and stitched sheets in a discharging direction when the folding/stitching plate is returned from the folding/stitching position to the standby position.

The tenth aspect of the present invention provides the folding/stitching apparatus according to the ninth aspect of this invention, wherein a pair of folding rollers is provided at a position to which the sheets are guided by the sheet lead-out member, and the sheets being inserted between the folding rollers are moved in a discharging direction by rotation of the pair of folding rollers.

The eleventh aspect of the present invention provides the folding/stitching apparatus according to the ninth aspect of this invention, wherein the folding/stitching plate is returned from the folding/stitching position to the standby position, and then the sheet lead-out member is moved in conjunction with operations of both the handle and the folding/stitching plate.

The twelfth aspect of the present invention provides the folding/stitching apparatus according to the tenth aspect of this invention, wherein the pair of folding rollers is rotated in conjunction with an operation of the handle.

The thirteenth aspect of the present invention provides the folding/stitching apparatus according to the tenth aspect of this invention, wherein the pair of folding rollers is rotated by the driving force of the motor.

DETAILED DESCRIPTION OF THE PREFERRED EMBODIMENTS

Hereafter, in order to describe the present invention more in detail, preferred embodiments of this invention will be explained with reference to the accompanied drawings below.

Figure 1:
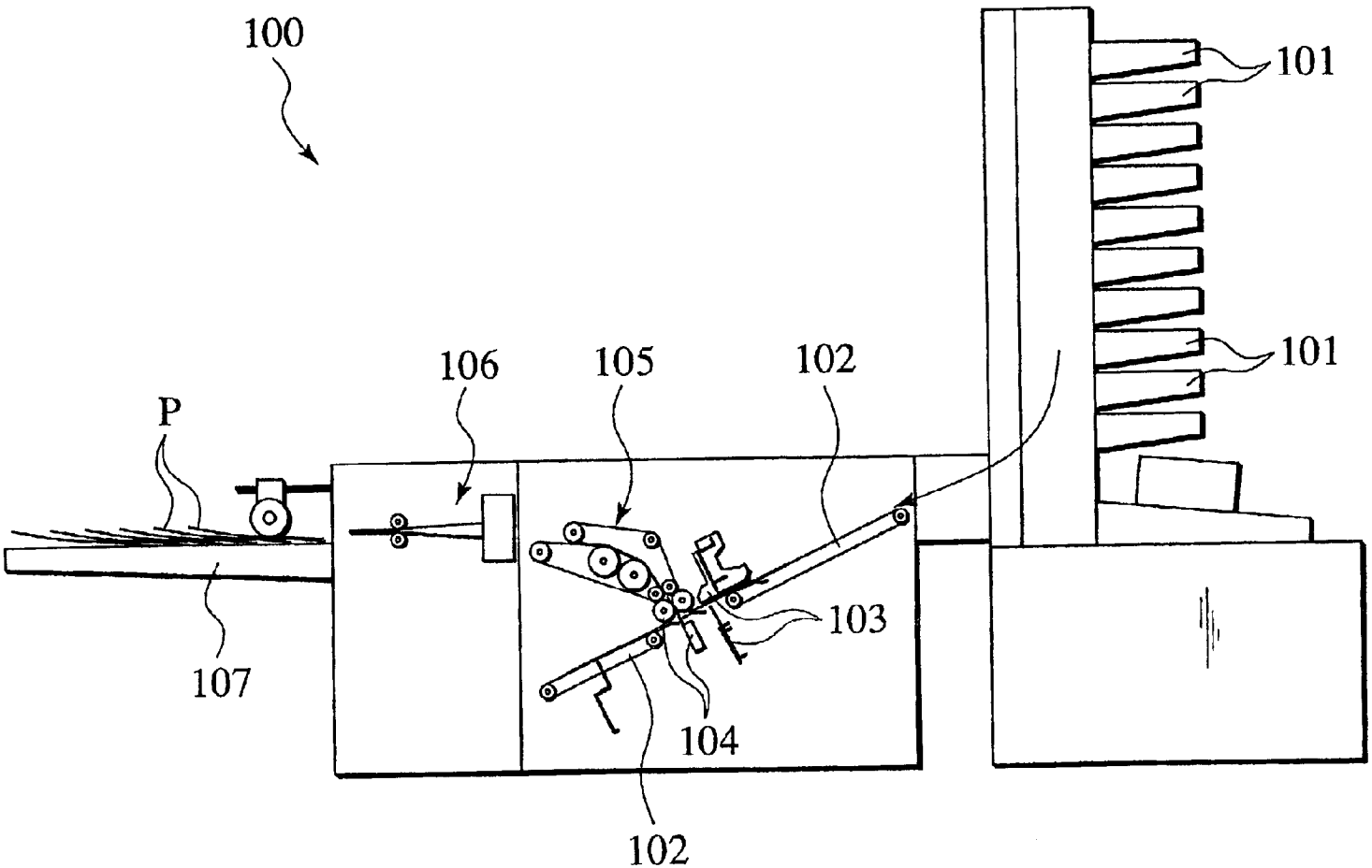
FIG. 1 is a schematic constitutional view of a proposed folding/stitching apparatus.
Figure 2:
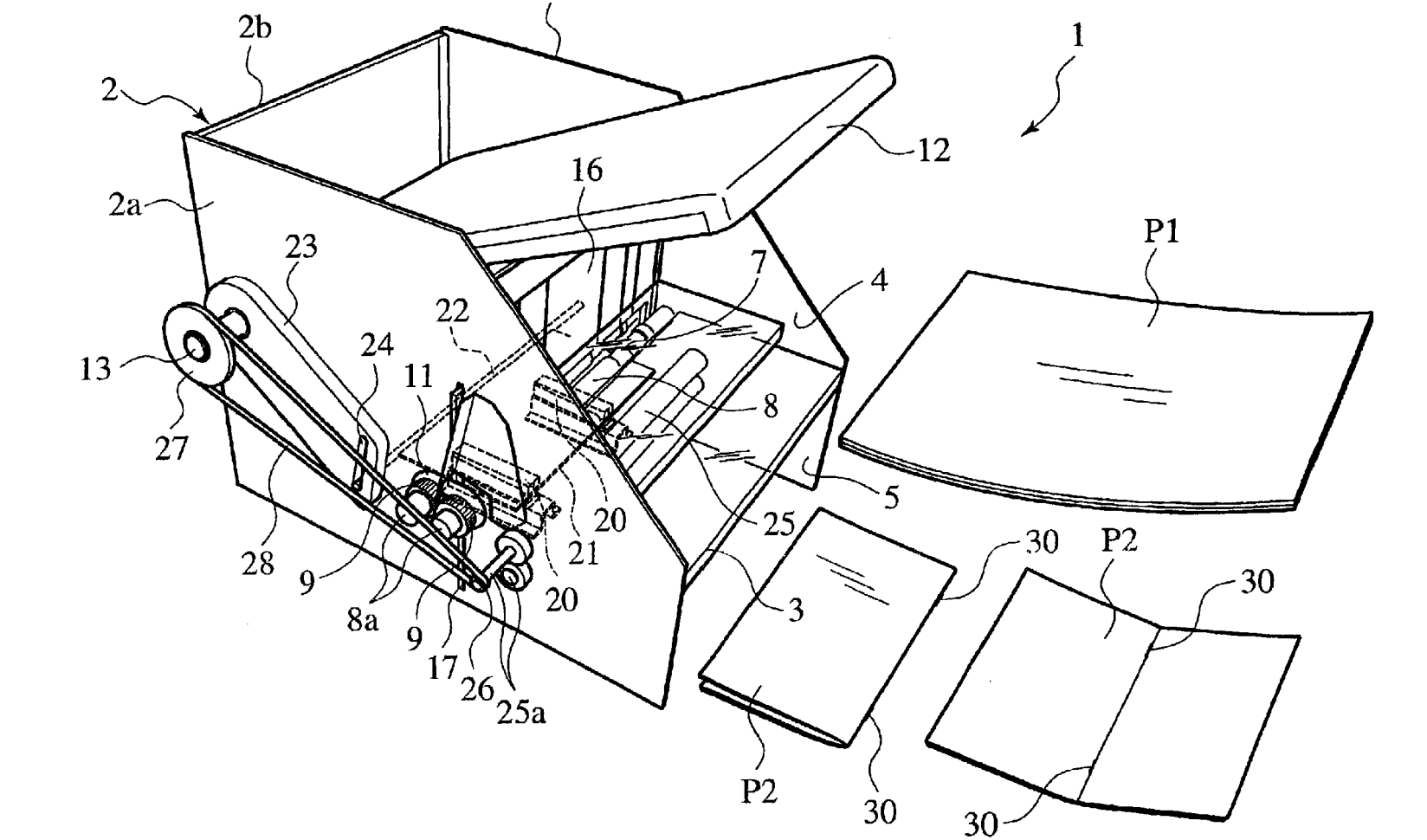
FIG. 2 is a perspective view showing a folding/stitching apparatus according to a first embodiment.
Figure 3:
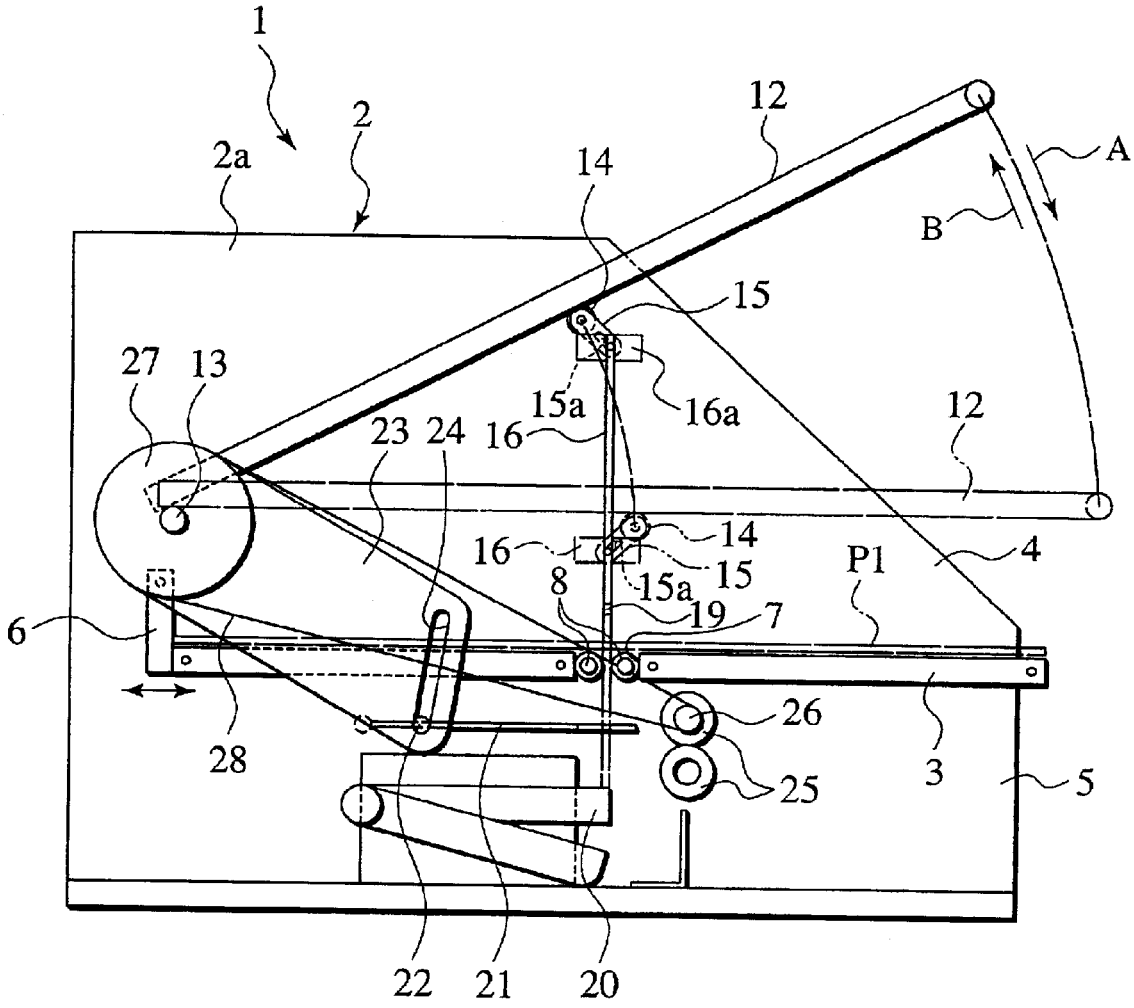
FIG. 3 is a schematic constitutional view showing the folding/stitching apparatus of the first embodiment.
Figure 4:
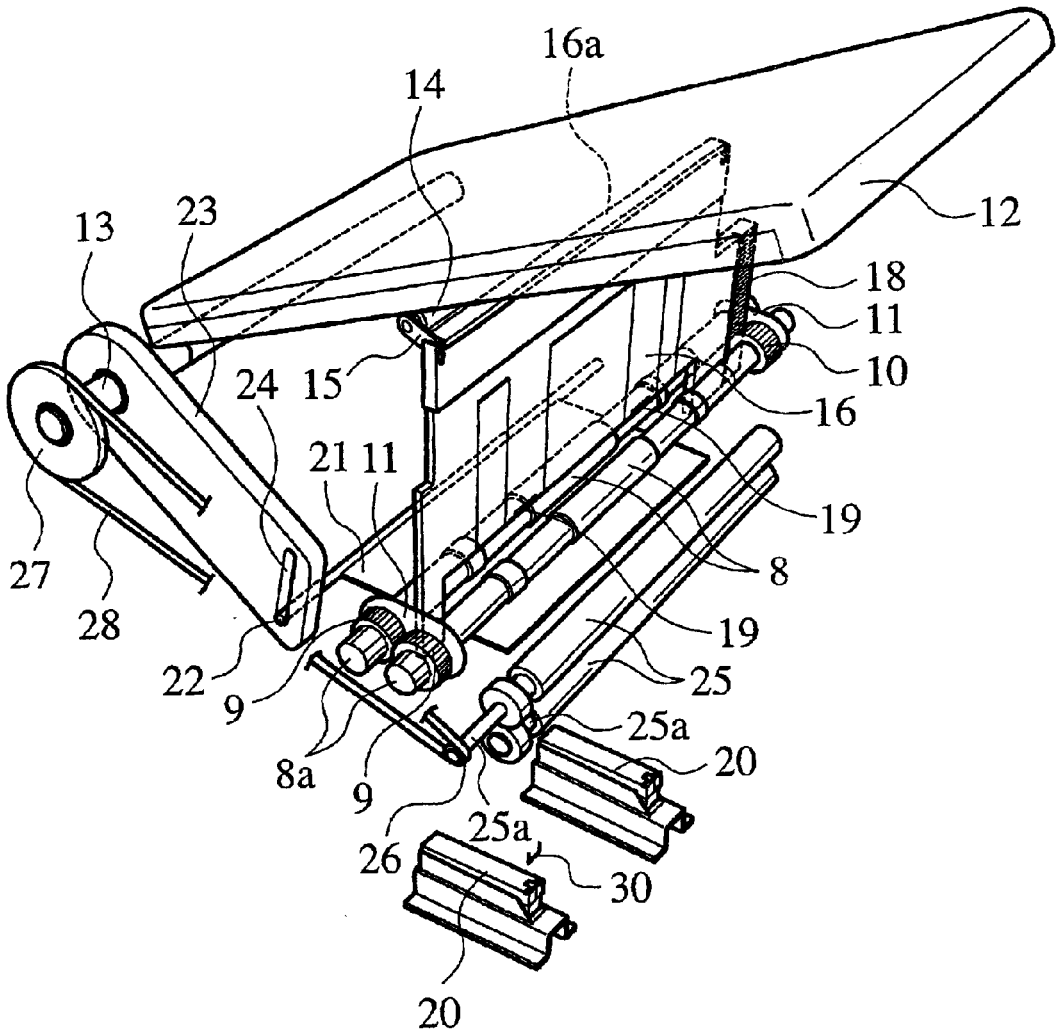
FIG. 4 is a perspective view showing main portions of the folding/stitching apparatus of the first embodiment.

As shown in FIGS. 2 to 4, a case 2 of a folding/stitching apparatus 1 includes a pair of paper guides 2*a* and 2*a* erected in parallel with each other at a fixed space, and a rear plate 2*b* for connecting the pair of paper guides 2*a* and 2*a* to be integral with each other in a rear side. A sheet setting tray 3 disposed in a horizontal direction is fixed between the pair of paper guides 2*a* and 2*a*, a space above the sheet setting tray 3 is used as a paper feed space 4, and a space below the sheet setting tray 3 is used as a paper discharge space 5. A plurality of superimposed (laminated) sheets P1 are set on the sheet setting tray 3 from a front side, and folded and saddle-stitched sheets P2 are taken out from the front side below the sheet setting tray 3.

A stopper member 6 is provided in a rear side of the sheet setting tray 3. The stopper member 6 enables the sheets P1 to be easily set in a predetermined position on the sheet setting tray 3. Namely, by being advanced to reach the stopper member 6, the plurality of sheets P1 can be easily set with a folding stitching position thereof aligned with a slit position. The stopper member 6 can be freely moved back and forth on the sheet setting tray 3 and positioned in a proper place. Accordingly, regarding the sheets P1 of various sizes, folding/stitching positions thereof can be variably set in desired positions. A slit 7 is provided roughly in a center of the sheet setting tray 3. This slit 7 is extended left and right, and provided to be longer than a width of at least the sheet P1 to be folded and saddle-stitched.

As shown in FIG. 3, a pair of introduction rollers 8 and 8 is rotatably provided in the slit 7. Gears 9 are provided to be engaged with each other, each of which is fixed on one end of a rod 8*a* of each introduction roller 8. As shown in FIG. 4, a pinion is fixed on the other end of the rod 8*a* of one introduction roller 8. The pinion 10 is engaged with a rack 18 of a later-described folding/stitching plate 16. Namely, the pair of introduction rollers 8 and 8 are moved in conjunction with movement of the folding/stitching plate 16 from a standby position to a folding/stitching position, and rotated in a direction for moving the folded sheets P1 integrally with the folding/stitching plate 16. The pair of introduction rollers 8 and 8 are freely moved in directions for contacting with/separating from each other while the engagement of the gears 9 with each other is maintained, and pressed in the contacting direction by a spring 11 as urging means. Further, a not-shown one-way clutch is interposed between each introduction roller 8 and each rod 8*a*. Rotation for advancing the sheets P1 into the slit 7 is transmitted from each rod 8*a* to each introduction roller 8, while rotation in an opposite direction thereto cannot be transmitted.

As shown in FIGS. 2 to 4, a handle 12 is provided between the pair of paper guides 2*a* and 2*a* in a manner that a base end side thereof is rotatably supported by a rod 13, and a tip side thereof is disposed above the sheet setting tray 3, thereby enabling a user to manually operate the handle. The operation of the handle 12 includes a feeding operation in an arrow direction A and a returning operation in an arrow direction B of FIG. 3. A pressure roller 14 is rotatably supported below a middle position of the handle 12. The pressure roller 14 is abutted on a pressure application portion 16*a* of the folding/stitching plate 16.

The folding/stitching plate 16 is disposed in a position above the sheet setting tray 3, which corresponds to a position of the slit 7 of the sheet setting tray 3. Parts of both left and right ends of the folding/stitching plate 16 are inserted into guide holes 17 (see FIG. 2) provided in both of the pair of paper guides 2*a* and 2*a*. Each guide hole 17 is extended in upper and lower directions.

The pressure application portion 16*a* is fixed on an upper end of the folding/stitching plate 16. The pressure application portion 16*a* and a member for supporting the pressure roller 14 of the handle 12 are connected to each other by a connecting member 15, and the pressure application portion 16*a* and the connecting member 15 are connected to each other through a long hole 15*a*, thereby maintaining connection while slightly varying a length of linkage. In conjunction with the operation of the handle 12, the folding/stitching plate 16 is moved between a standby position indicated by a solid line shown in FIG. 3, where the plate is not inserted into the slit 7 of the sheet setting tray 3, and a folding/stitching position indicated by a virtual line shown in FIG. 3, where the plate is inserted into the slit 7 of the sheet setting tray 3.

The rack 18 is provided in a place protruded from the paper guide 2*a* in one end of the folding/stitching plate 16. As described above, the rack 18 is engaged with the pinion 10 of the pair of introduction rollers 8 and 8. Moreover, the pair of introduction rollers 8 and 8 are rotated when the folding/stitching plate 16 is moved from the standby position to the folding/stitching position. Namely, the pair of introduction rollers 8 and 8 are also rotated in conjunction with the feeding operation of the handle 12.

Staple bending portions 19 are provided in positions corresponding to a pair of staplers 20 and 20 in a lower end (i.e., insertion tip of the slit 7) of the folding/stitching plate 16. Each stapler 20 is fixed in a position below the slit 7 of the sheet setting tray 3, and disposed to stick a U-shaped staple 30 upward. Further, each stapler 20 is pressed into contact through the sheets P1 with the folding/stitching plate 16 set in the folding/stitching position. By such press-contact force, the staple 30 is stuck into the sheets P1.

As shown in FIGS. 2 to 4, a sheet lead-out member 21 is provided in a position below the sheet setting tray 3 between the pair of paper guides 2*a* and 2*a* slidably in a horizontal direction. A support pin 22 of the sheet lead-out member 21 is engaged with a cam hole 24 of a swing plate 23 fixed on the rod 13 of the handle 12, and thus moved in conjunction with the rotating operation of the handle 12. Namely, in a lower position of the handle 12 where the folding/stitching plate 16 is in the folding/stitching position, the sheet lead-out member 21 is moved out from a position below the slit 7 to permit entry of the sheets P1, and set in the standby position indicated by the virtual line shown in FIG. 3, where the sheets P1 are not guided in the discharging direction. In an upper position of the handle 12 where the folding/stitching plate 16 is in the standby position, the sheet lead-out member 21 is protruded from a position below the slit 7, and set in a lead-out position indicated by a solid line shown in FIG. 3, where sheets P2 are guided in the discharging direction.

A pair of folding rollers 25 and 25 is provided in positions below the sheet setting tray 3 between the pair of paper guides 2*a* and 2*a*, where the sheets P2 folded and saddle-stitched are guided by the sheet lead-out member 21. A pulley 26 is provided in one rod 25*a* of the pair of folding rollers 25 and 25. A belt 28 is placed between the pulley 26 and a pulley 27 fixed on the rod 13 of the handle 12.

A not-shown one-way clutch is interposed between each folding roller 25 and each rod 25*a*, and thus only rotation in a direction for moving the folded and saddle-stitched sheets P2 in the discharging direction can be transmitted from each rod 25*a* to each folding roller 25. When the handle 12 is rotated from the lower position to the upper position, such rotation is transmitted through the belt 28 to the pair of folding rollers 25 and 25, and the pair of folding rollers 25 and 25 are rotated to move the sandwiched sheets P2 in the discharging direction.

Now, a folding/stitching operation of the folding/stitching apparatus 1 will be described by way of example, where sheets P1 of a predetermined size are folded and saddle-stitched precisely in a middle position. The position of the stopper member 6 is adjusted such that a precisely middle position of the sheets P1 can be aligned with that of the slit 7 when the sheets P1 of a predetermined size are loaded on the sheet setting tray 3 to be abutted on the stopper member 6.

Figure 5:
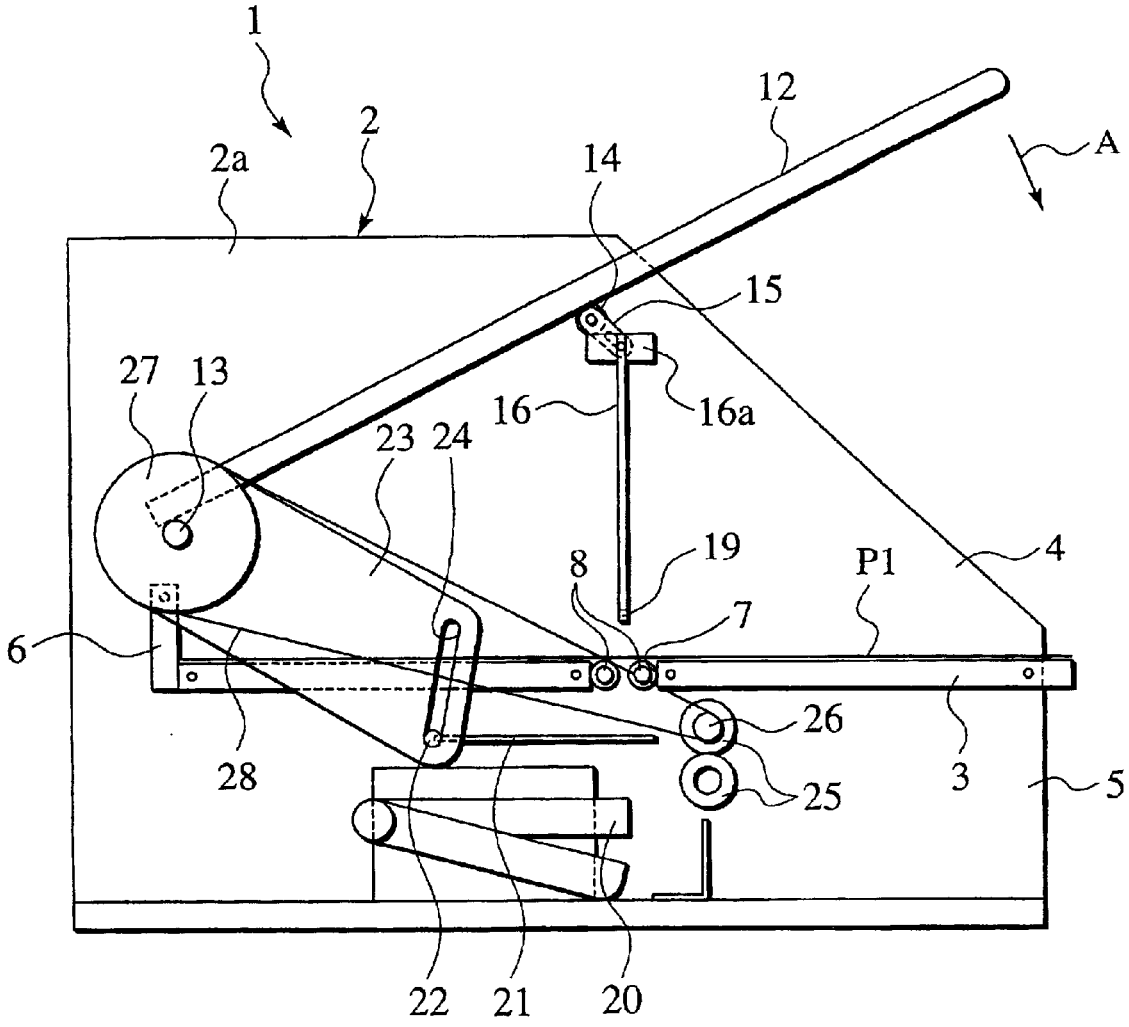
FIG. 5 is a schematic constitutional view showing a state where a plurality of sheets are set on a sheet setting tray according to the first embodiment.

As shown in FIG. 5, a user inserts a plurality of superimposed sheets P1 on the sheet setting tray 3, and then insertion tip surfaces of the sheets P1 are set in a position for abutment on the stopper member 6. Next, when the handle 12 is operated for feeding in an arrow direction A in FIG. 5, the folding/stitching plate 6 in the standby position is lowered from above the sheets P1, and abutted on the sheets P1. When the handle 12 is further operated for feeding from such abutted state, the sheets P1 are folded in the abutting position by the folding/stitching plate 16, and then inserted into the slit 7 of the sheet setting tray 3 integrally with the folding/stitching plate 16.

By the lowering of the folding/stitching plate 16, the pair of introduction rollers 8 and 8 are rotated in a direction for moving the sheets P1 integrally with the folding/stitching plate 16, and then the sheets P1 are smoothly inserted into the slit 7. By the feeding operation of the handle 12, the sheet lead-out member 21 is moved out from the lead-out position below the slit 7, so that the folding/stitching plate 16 and the sheets P1 accordingly inserted are permitted to be moved.

Figure 6:
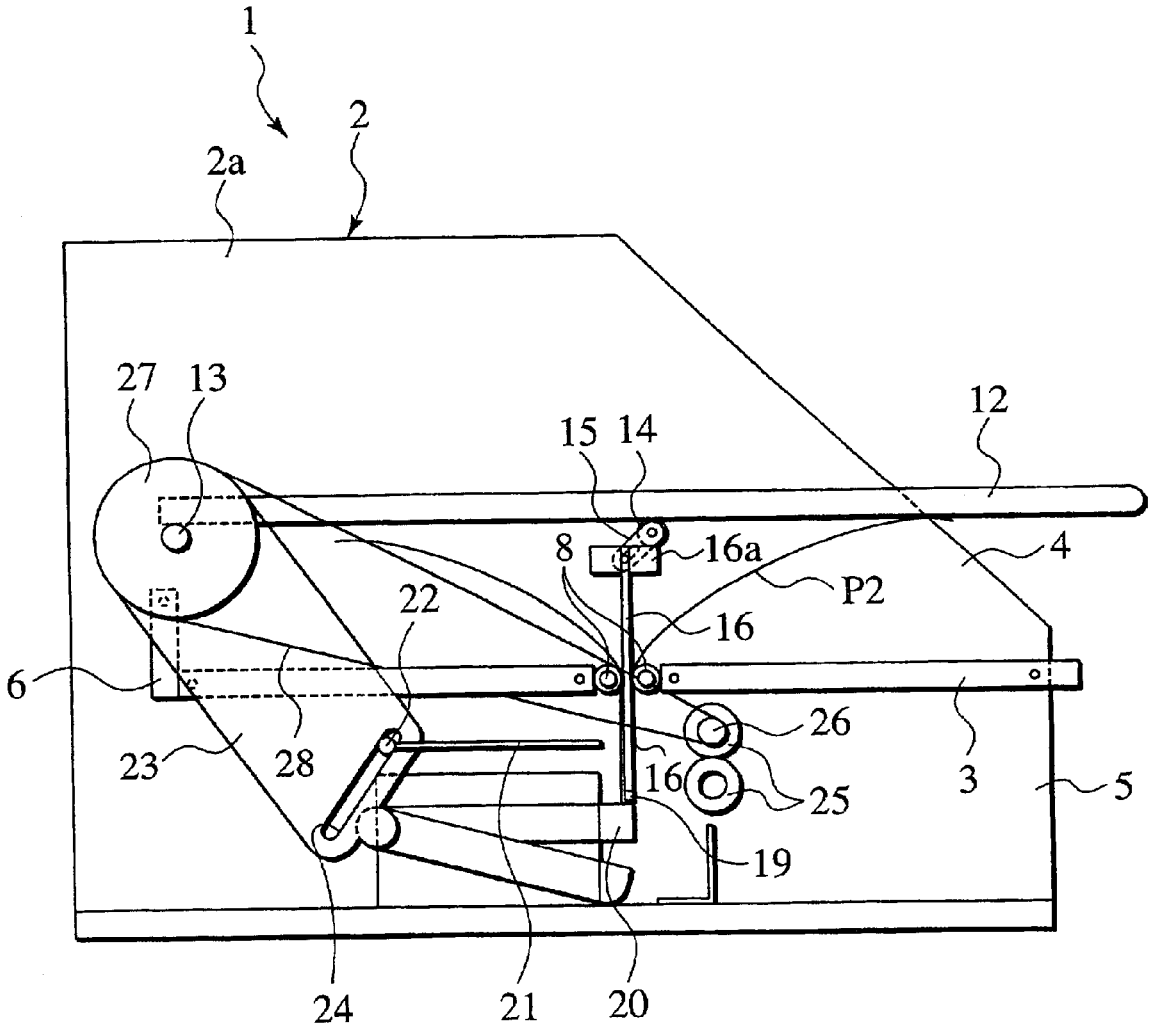
FIG. 6 is a schematic constitutional view showing a state where a folding/stitching plate is in a folding/stitching position.

The user stops the feeding operation of the handle 12 when the folding/stitching plate 16 reaches the folding/stitching position. As shown in FIG. 6, when the folding/stitching plate 16 is lowered to the folding/stitching position, the staple bending portions 19 of the folding/stitching plate 16 are pressed into contact through the sheets P1 with the pair of staplers 20 and 20. By such press-contact force, each stapler 20 sticks staples, and then a tip of the staple 30 stuck into the sheets P1 is bent by the staple bending portions 19. The plurality of superimposed sheets P1 become folded and saddle-stitched sheets P2.

Figure 7:
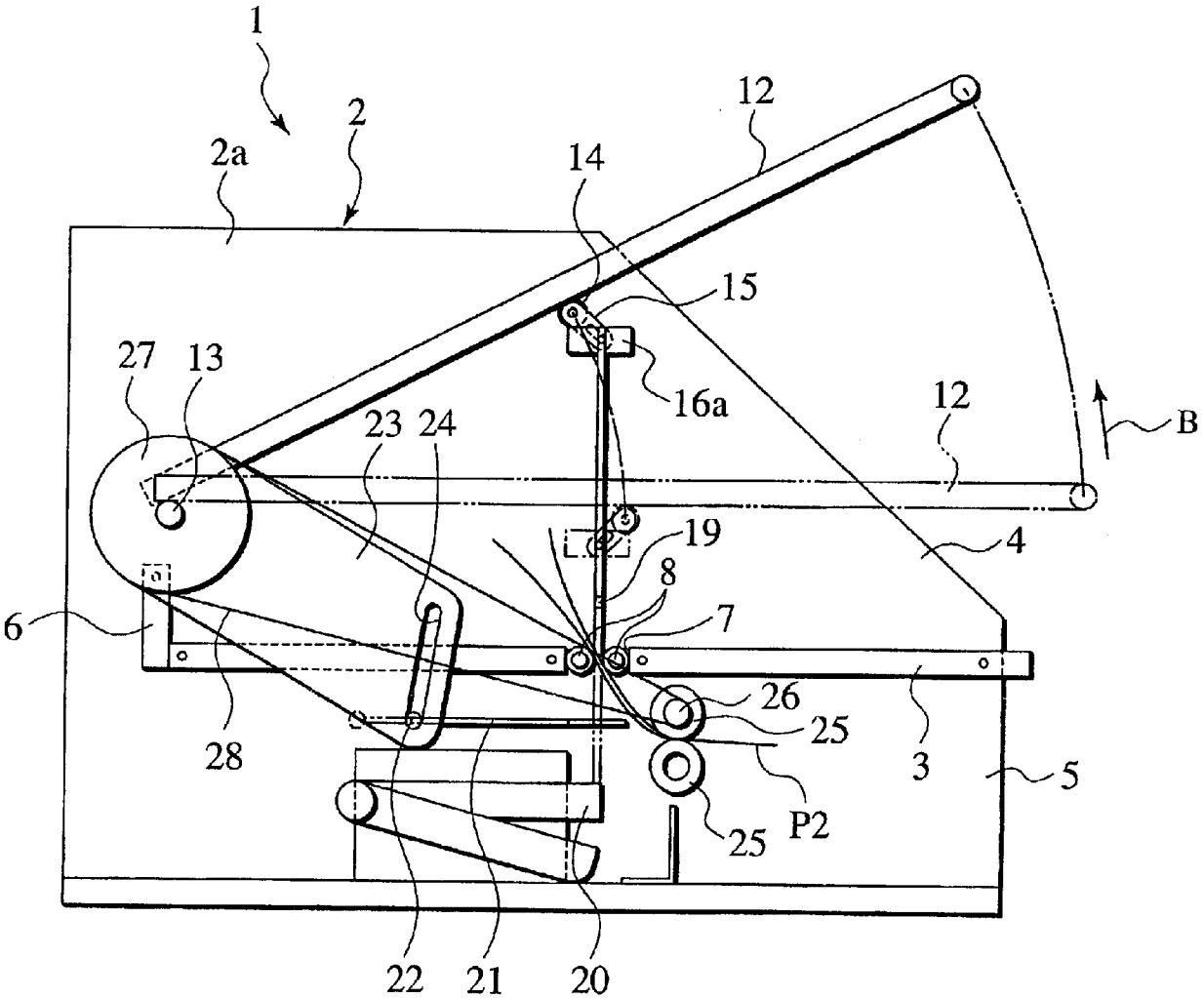
FIG. 7 is a schematic constitutional view showing a state where the folding/stitching plate has been returned from the folding/stitching position to a standby position according to the first embodiment.

Next, when the user returns the handle 12 in an arrow direction B in FIG. 7, the folding/stitching plate 16 is raised in conjunction with the returning operation of the handle 12. The pair of introduction rollers 8 and 8 are not rotary-driven in conjunction with the movement of the folding/stitching plate 16 by the one-way clutch, and thus the folded and saddle-stitched sheets P2 are retained in the position without being raised integrally with the folding/stitching plate 16. Further, in conjunction with the returning operation of the handle 12, the sheet lead-out member 21 is protruded from the standby position to the lead-out position below the slit, and the folded and saddle-stitched sheets P2 are guided to the pair of folding rollers 25 and 25 in the discharging direction. The pair of folding rollers 25 and 25 are rotated in the direction for discharging the folded and saddle-stitched sheets P2 in conjunction with the returning operation of the handle 12. Therefore, as shown in FIG. 7, the folded and saddle-stitched sheets P2 are passed between the pair of folding rollers 25 and 25, and then guided in the discharging direction.

After having finished the returning operation of the handle 12, the user pulls out the folded and saddle-stitched sheets P2 protruded from the pair of the folding rollers 25 and 25. Then, the pair of folding rollers 25 and 25 are run idle by the one-way clutch, thereby facilitating the pulling-out of the folded and stitched sheets P2.

The pair of introduction rollers 8 and 8 are also run idle by the one-way clutch. Thus, the pulling-out of the folded and stitched sheets P2 is not interfered with.

In the folding/stitching apparatus 1, the sheets P1 are set on the sheet setting tray 3 such that the folding position can be aligned with that of the slit 7. When the folding/stitching plate 16 is moved from the standby position toward the folding/stitching position, the sheets P1 are folded in the tip position of the folding/stitching plate 16 and inserted into the slit 7. When the folding/stitching plate 16 is moved to the folding/stitching position, staples are stuck into the sheets P1 by the staplers 20 in the tip position of the folding/stitching plate 16, and thus the folding position and the saddle-stitching position of the sheets P1 are naturally brought into agreement with each other. Therefore, it is not necessary to add any positioning units. Accordingly, it is possible to provide a folding/stitching apparatus 1 high in accuracy of the folding and saddle-stitching positions and simple in structure.

According to the first embodiment, the handle 12, which can be manually operated by the user, is provided, and the folding/stitching plate 16 is moved between the standby position and the folding/stitching position in conjunction with the operation of the handle 12. Accordingly, the folding/stitching operation can be manually performed by the user, thereby achieving a simple structure and low costs.

According to the first embodiment, the pair of introduction rollers 8 and 8 are provided in the slit 7, and the folding/stitching plate 16 is provided so as to enter between the pair of introduction rollers 8 and 8 integrally with the sheets P1. Thus, in the process of the insertion of the plurality of sheets P1 into the slit 7 by the folding/stitching plate 16, the plurality of sheets P1 are smoothly moved by the pair of introduction rollers 8 and 8. Accordingly, a folding operation can be carried out by preventing damage from being given to the sheets P1 as much as possible.

According to the first embodiment, the pair of introduction rollers 8 and 8 are freely moved in the contacting/separating directions, and pressed in the contacting direction by the spring 11 as the urging means. Hence, a space between the pair of introduction rollers 8 and 8 is varied according to a total thickness of the plurality of sheets P1, and a predetermined sandwiching force is applied by the spring 11 as the urging means such that the sheets P1 varied in total thickness can be folded. When the folding/stitching plate 16 is moved from the standby position to the folding/stitching position, the pair of introduction rollers 8 and 8 are rotated in the direction for integrally moving the sandwiched sheets P1. Thus, when the sheets P1 are pressed and folded by the folding/stitching plate 16, the pair of introduction rollers 8 and 8 feed the sheets P1 integrally. Therefore, the sheets P1 are smoothly folded. Moreover, when the folding/stitching plate 16 is advanced from the standby position to the folding/stitching position, the pair of introduction rollers 8 and 8 are rotated in conjunction with the operation of the handle 12. Therefore, driving of the pair of introduction rollers 8 and 8 leads not be performed separately so that high usability can be provided for the user.

According to the first embodiment, the sheet lead-out member 21 is provided for guiding the folded and stitched sheets P2 in the discharging direction when the folding/stitching plate 16 is returned from the folding/stitching position to the standby position. Accordingly, the folded and stitched sheets P2 are discharged to the position for easily taking-out the sheets P2, thereby providing high usability for the user.

According to the first embodiment, the pair of folding rollers 25 and 25 are provided in the position, to which the sheets P2 are guided by the sheet lead-out member 21. The sheets P2 entered between the pair of folding rollers 25 and 25 are moved in the discharging direction by rotation, so that the folded and stitched sheets P2 can be discharged to a position for easier taking-out, and folded well. Accordingly, high usability is provided for the user. Further, when the folding/stitching plate 16 is returned from the folding/stitching position to the standby position, the sheet lead-out member 21 is moved in conjunction with the operation of the handle 12. Therefore, driving of the sheet lead-out member 21 needs not be performed separately so that high usability can be provided for the user.

According to the first embodiment, the pair of folding rollers 25 and 25 are rotated in conjunction with the operation of the handle 12. Rotational driving of the pair of folding rollers 25 and 25 needs not be performed separately, thereby providing high usability for the user.

According to the first embodiment, the folding/stitching apparatus 1 is constructed without using any power sources. Therefore, it is possible to manufacture the folding/stitching apparatus 1 at much lower costs compared with the proposed art.

Next, description will be made for a second embodiment of the present invention.

Figure 8:
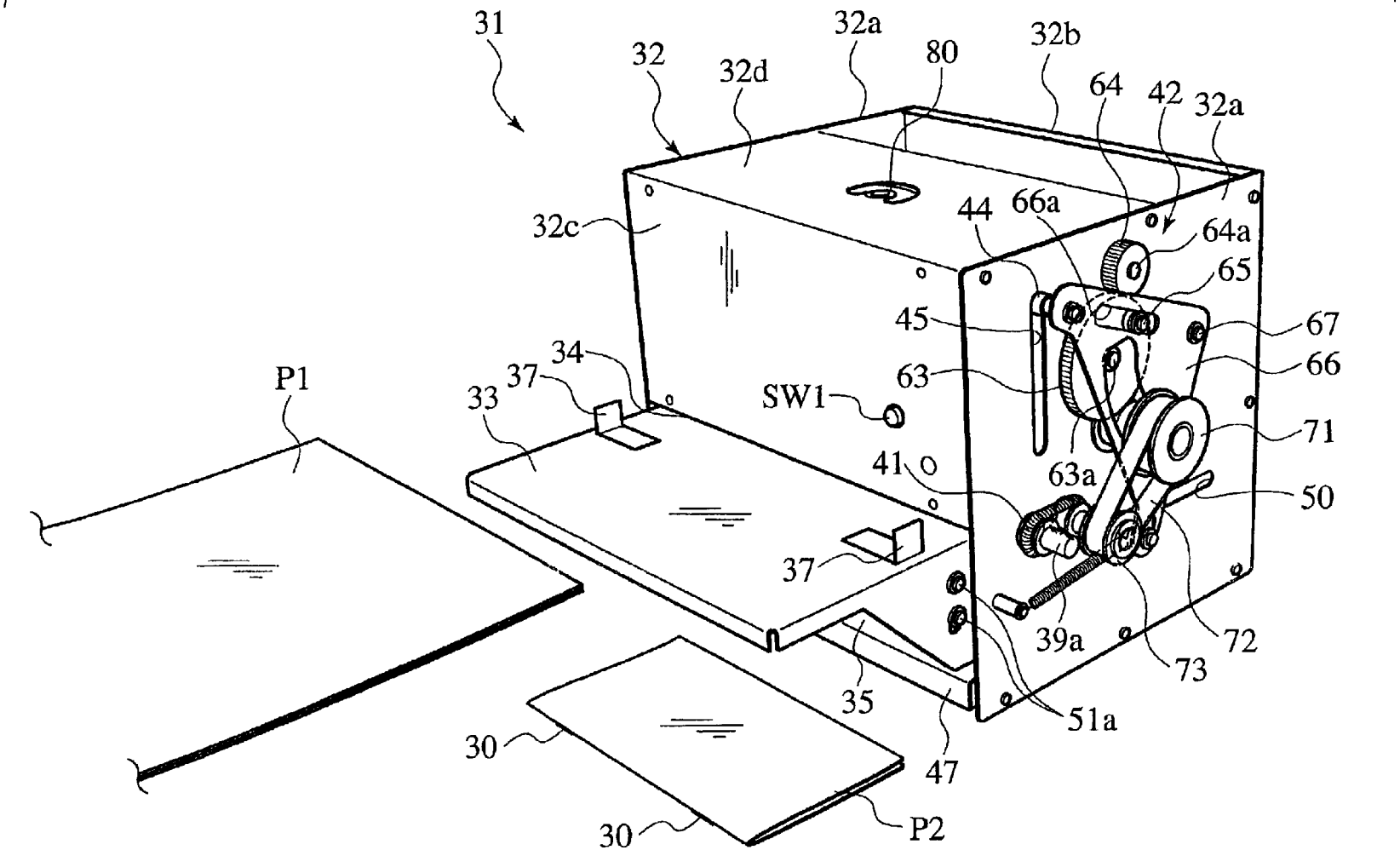
FIG. 8 is a perspective view of a folding/stitching apparatus according to a second embodiment.
Figure 9:
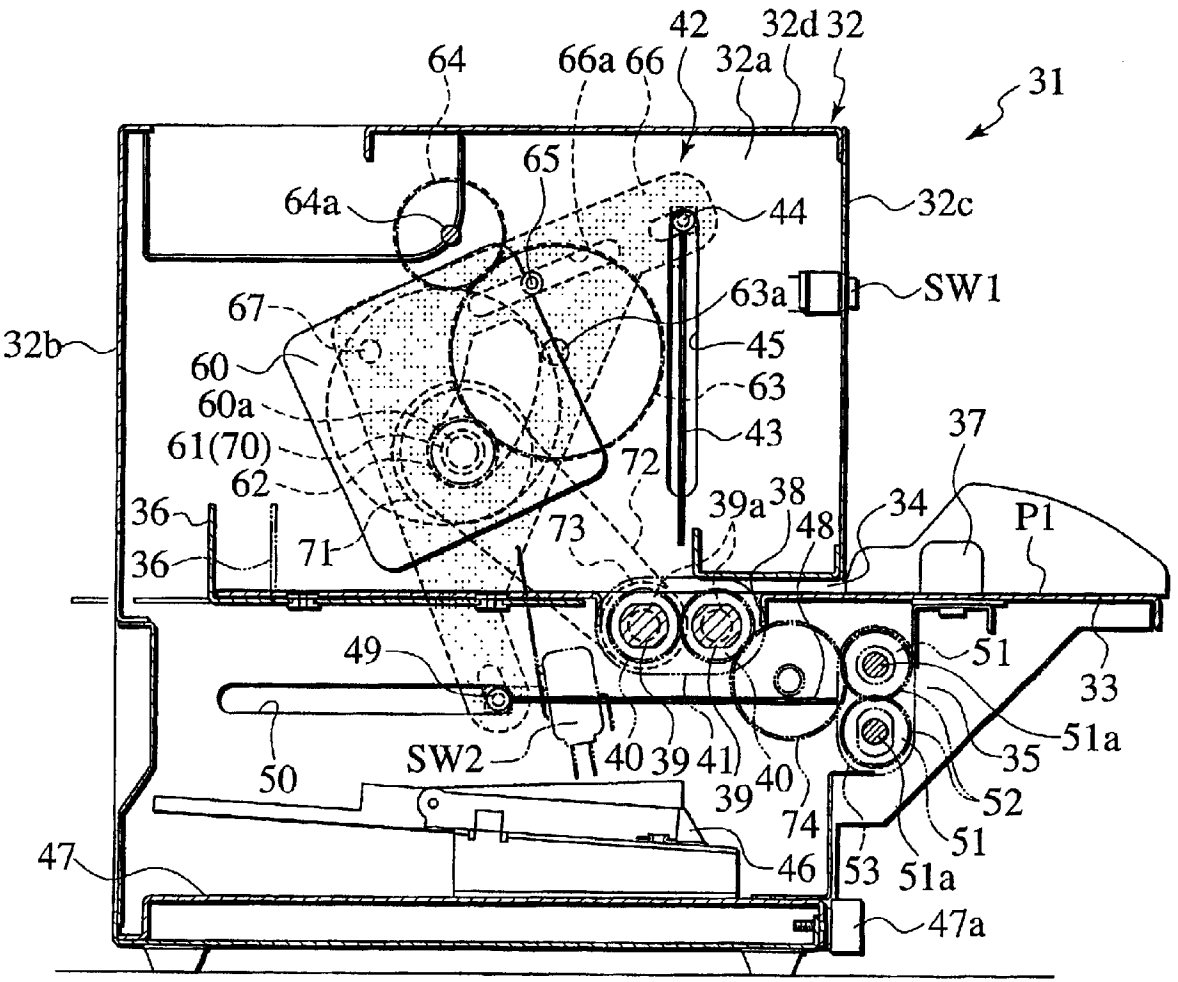
FIG. 9 is a schematic constitutional view of the folding/stitching apparatus in a state where a folding/stitching plate is in a standby position and a plurality of sheets are set on a sheet setting tray according to the second embodiment.

As shown in FIGS. 8 and 9, a case 32 of a folding/stitching apparatus 31 includes a pair of paper guides 32*a* and 32*a* erected in parallel with each other at a fixed space, a rear plate 32*b* for connecting the pair of paper guides 32*a* and 32*a* to be integral with each other in a rear side, a front plate 32*c* for connecting the pair of paper guides 32*a* and 32*a* to be integral with each other in a front side, and an upper plate 32*d* for connecting the pair of paper guides 32*a* and 32*a* to be integral with each other in an upper side. A sheet setting tray 33 disposed in a horizontal direction is fixed between the pair of paper guides 32*a* and 32*a*. A space between the front plate 32*c* and the sheet setting tray 33 is used as a paper feed space 34, and a space below the sheet setting tray 33 is used as a paper discharge space 35. A plurality of superimposed (laminated) sheets P1 are set on the sheet setting tray 33 from a front side, and folded and saddle-stitched sheets P2 are taken out from a front side below the sheet setting tray 33.

As in the case of the first embodiment, a stopper member 36 is provided in a rear side of the sheet setting tray 33. The stopper member 36 enables the sheets P1 to be easily set in a predetermined position on the sheet setting tray 33. The stopper member 36 can be freely moved back and forth on the sheet setting tray 33, and positioned in a proper place. Therefore, regarding the sheets P1 of various sizes, folding/stitching positions thereof can be variably set in desired positions.

A pair of left and right sheet guides 37 and 37 is provided near left and right edge positions in a front portion of the sheet setting tray 33. By the pair of left and right sheet guides 37 and 37, a plurality of sheets P1 can be set on the same left and right position without being shifted left or right.

A slit 38 is provided roughly in a center of the sheet setting tray 33. The slit 38 is extended left and right and provided to be sufficiently longer than a width of the sheet P1 to be folded and saddle-stitched.

Figure 13:
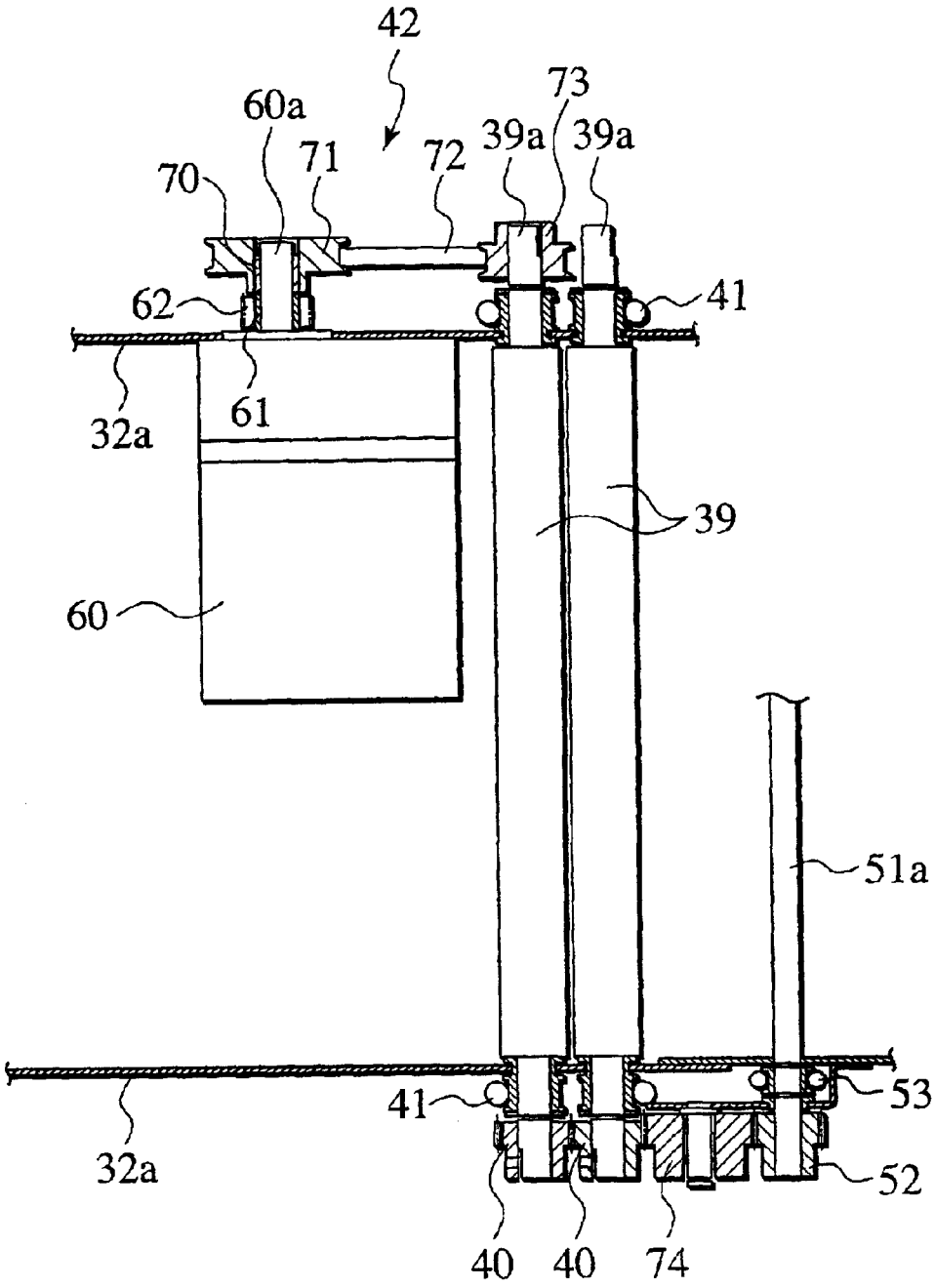
FIG. 13 is a plan view showing the sheet discharge system of the folding/stitching unit of the second embodiment.

A pair of introduction rollers 39 and 39 is rotatably provided in the slit 38. A surface of each introduction roller 39 is made of, for example, a rubber having 60 degrees about type A durometer hardness (this hardness is consistent with ISO 7619), requiring only a frictional force but not elasticity. Gears 40 and 40 are provided to be engaged with each other, each of which is fixed on one end of each of rods 39*a* and 39*a* of the introduction rollers 39 and 39. As shown in FIG. 13, the pair of introduction rollers 39 and 39 are freely moved in directions for contacting with/separating from each other while the engagement of the gears 40 and 40 with each other is maintained. Further, the pair of introduction rollers 39 and 39 are pressed in the contacting direction by a spring 41 as urging means. The pair of introduction rollers 39 and 39 are rotary-driven by a sheet discharge system of a folding/stitching drive unit 42 in a direction for inserting the sheets P1 into the slit 38.

A one-way clutch (not-shown) is interposed between each introduction roller 39 and each rod 39*a*. Rotation for advancing the sheets P1 into the slit 38 is transmitted from each rod 39*a* to each of the pair of introduction rollers 39 and 39, while rotation of an opposite direction thereto cannot be transmitted. Thus, when a folding/stitching plate 43 is moved from a standby position to a folding/stitching position, the pair of introduction rollers 39 and 39 are freely rotated in a direction for moving the folded sheets P1 integrally with the folding/stitching plate 43.

Figure 16:
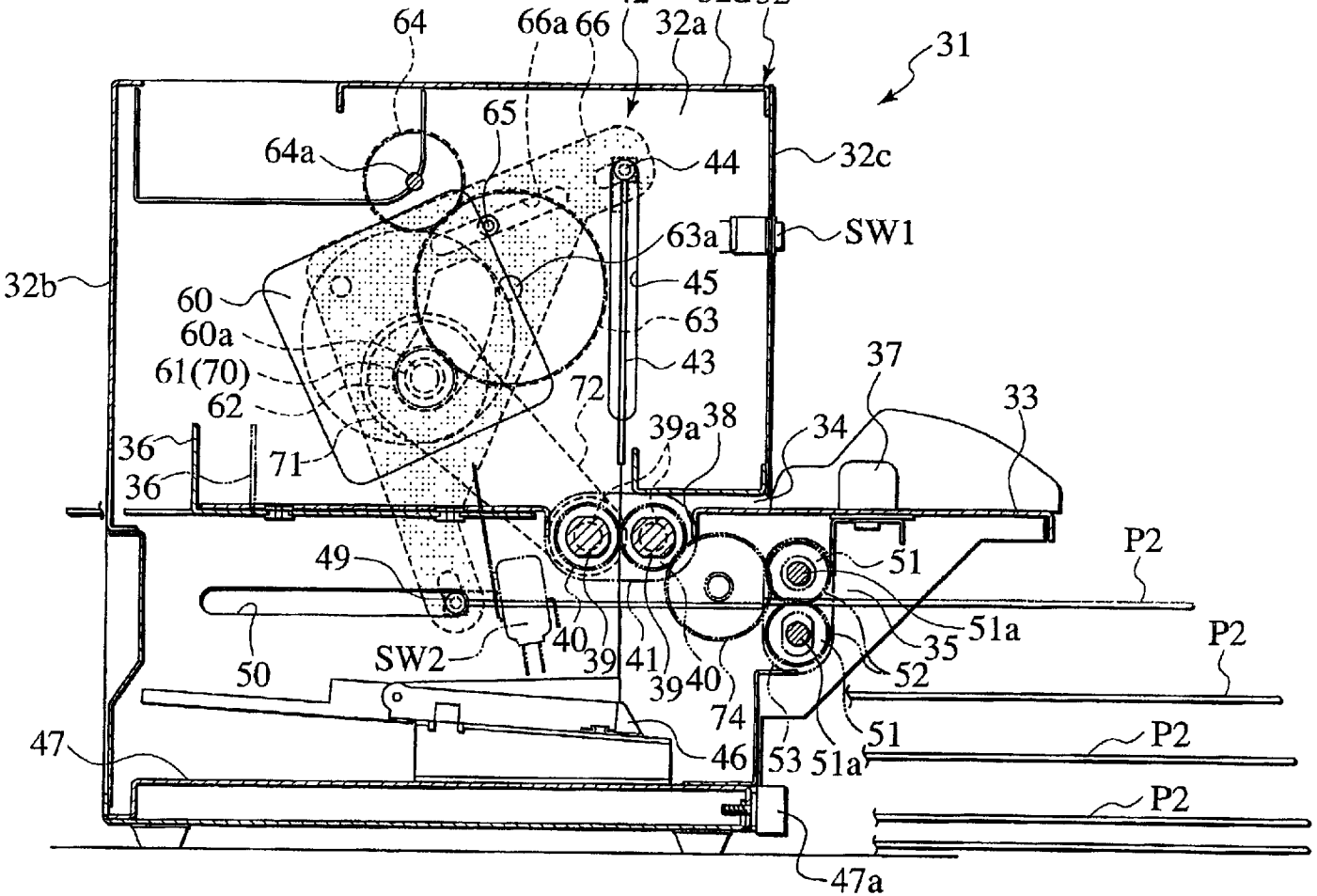
FIG. 16 is a schematic constitutional view of the folding/stitching apparatus in a state where the folding/stitching plate has been returned from the folding/stitching position to the standby position according to the second embodiment.

The folding/stitching plate 43 is disposed in a position above the sheet setting tray 33, which corresponds to a position of the slit 38 of the sheet setting tray 33. In an upper end of the folding/stitching plate 43, guide pins 44 are provided to be protruded from both left and right ends. The left and right guide pins 44 are inserted into guide holes 45 respectively provided in the pair of paper guides 32*a* and 32*a*. Each guide hole 45 is extended in upper and lower directions. Further, the folding/stitching plate 43 is driven by a folding/stitching drive system of the folding/stitching drive unit 42 between the standby position for not entering the slit 38 of the sheet setting-tray 33 shown in FIG. 9 and the folding/stitching position for entering the slit 38 of the sheet setting tray 33 shown in FIG. 16.

As in the case of the first embodiment, staple bending portions (not shown) are provided in positions corresponding to a pair of staplers 46 and 46 in a lower end (i.e., insertion tip into the slit 38) of the folding/stitching plate 43. Each stapler 46 is fixed in a position below the slit 38 of the sheet setting tray 33, and disposed to stick a U-shaped staple 30 upward. Moreover, each stapler 46 is pressed into contact through the sheets P1 with the folding/stitching plate 43 set in the folding/stitching position. By such press-contact force, the staple 30 is stuck into the sheets P1. The pair of staplers 46 and 46 are fixed on a stapler base 47 detachably disposed in the case 32. The stapler base 47 can be attached/detached by an operation of a knob 47*a*. The stapler base 47 is made of sheet metal having a spring characteristic and reduces a pressing force of the folding/stitching plate 43 applied on each stapler 46.

As shown in FIG. 9, a sheet lead-out member 48 is provided in a position below the sheet setting tray 33 between the pair of paper guides 32*a* and 32*a* slidably in a horizontal direction. A support pin 49 protruded from each of left and right ends of the sheet lead-out member 48 is inserted into a guide hole 50 provided in each of the pair of paper guides 32*a* and 32*a*. The guide hole 50 is extended in a horizontal direction. Then, the sheet lead-out member 48 is moved out from a position below the slit 38 to permit entry of the sheets P1. The sheet lead-out member 48 is driven by the folding/stitching drive system of the folding/stitching drive unit 42 between the standby position for not guiding the sheets P1 in the discharging direction shown in FIG. 16 and a lead-out position for being protruded from the position below the slit 38 to guide sheets P2 in the discharging direction shown in FIG. 9.

A pair of folding rollers 51 and 51 is provided in positions below the sheet setting tray 33 between the pair of paper guides 32*a* and 32*a*, where the sheets P2 folded and stitched are guided by the sheet lead-out member 48. Each folding roller 51 is made of, for example, rubber having 60 degrees or lower about type A durometer hardness (this hardness is consistent with ISO 7619) and having elasticity.

Gears 52 and 52 are provided to be engaged with each other, each of which is fixed on one end of each of rods 51*a* and 51*a* of the pair of folding rollers 51 and 51. Further, the pair of folding rollers 51 and 51 are freely moved in directions for contacting with/separating from each other while the engagement of the gears 52 and 52 with each other is maintained, and pressed in the contacting direction by a spring 53 as urging means. The spring 53 has a spring force set stronger than that of the spring 41 in the side of the pair of introduction rollers 39 and 39, and thus provides stronger folding than those in the pair of introduction rollers 39 and 39. Further, the pair of folding rollers 51 and 51 are rotary driven in a direction for discharging the sandwiched sheets P1 by the sheet discharge system of the folding/stitching drive unit 42.

A one-way clutch (not shown) is interposed between each folding roller 51 and each rod 51*a*. Rotation of a direction for moving the sheets P2 in a discharging direction is transmitted from each rod 51*a* to each folding roller 51. However, rotation of an opposite direction thereto cannot be transmitted. Therefore, when the user pulls the sandwiched sheets P2 in the discharging direction, the pair of folding rollers 51 and 51 are freely rotated to enable the jammed sheets P2 to be easily taken out.

Figure 10:
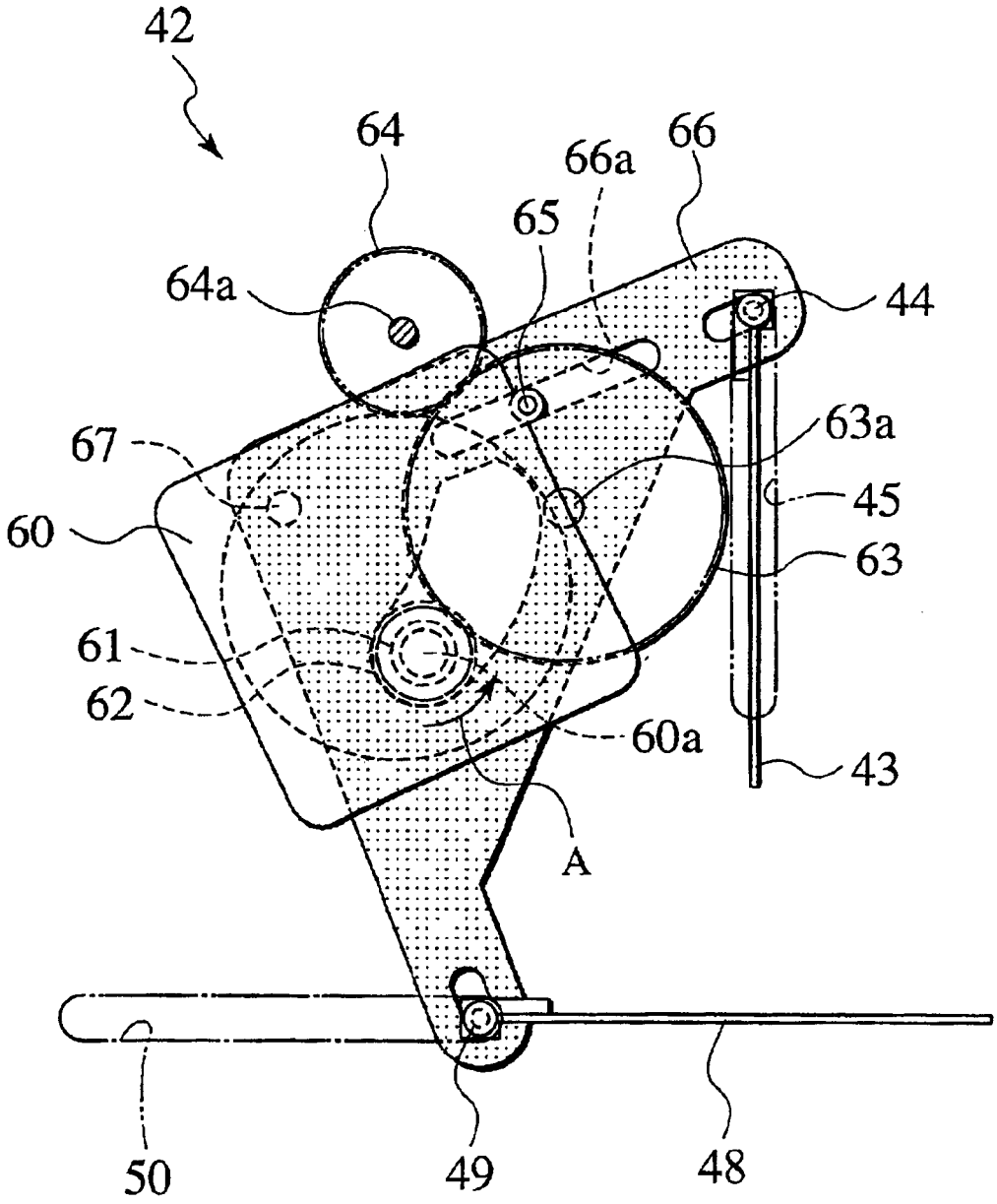
FIG. 10 is a front view showing main portions of a folding/stitching drive system of a folding/stitching drive unit according to the second embodiment.
Figure 11:
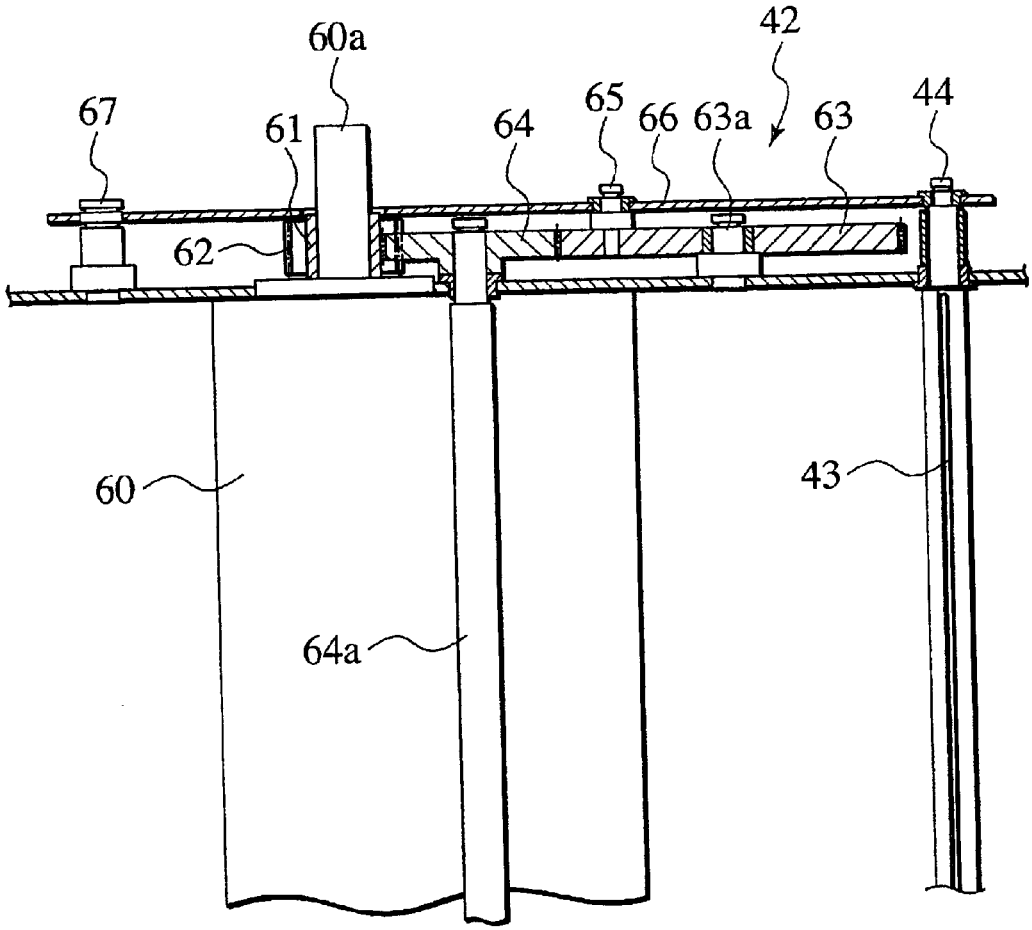
FIG. 11 is a plan view showing the folding/stitching drive system of the folding/stitching drive unit of the second embodiment.

Now, the folding/stitching drive unit 42 will be described. As shown in FIGS. 10 and 11, the folding/stitching drive system of the folding/stitching drive unit 42 includes an AC motor as the only driving source of the folding/stitching apparatus 31. On an outer peripheral surface of a rotary shaft 60*a* of the AC motor 60, a first gear 62 is provided by interposing a first one-way clutch 61. The first one-way clutch 61 transmits only rotation of a counterclockwise direction (arrow direction A seen in FIGS. 10 and 12, and similar thereinafter) of the AC motor 60 to the first gear 62. Clockwise rotation of the AC motor 60 causes the first gear 62 to run idle. The first gear 62 is engaged with a second gear 63 of a large diameter. The second gear 63 has a cam pin 65 fixed in an eccentric position of a rotary shaft support pin 63*a* thereof. The cam pin 65 is inserted into a cam hole 66*a* of a swing lever 66. The swing lever 66 is supported on the paper guide 32*a* with a center pin 67 set as a fulcrum. A guide pin 44 of the folding/stitching plate 43 is engaged with an upper side end of the swing lever 66. The swing plate 65 is swung by rotation of the second gear 63, so that the folding/stitching plate 43 can be moved up and down. A support pin 49 of the sheet lead-out member 48 is engaged with a lower side end of the swing lever 65. The swing lever 66 is swung by the rotation of the second gear 63 such that the sheet lead-out member 48 can be moved horizontally.

A third gear 64 is engaged with the second gear 63. A rod 64*a* of the third gear 64 is extended to the other paper guide 32*a*. Similar units (third and second gears 64 and 62, and swing lever 66) are provided in this paper guide 32*a*. Hence, the folding/stitching plate 43 and the sheet lead-out member 48 are surely and smoothly moved.

As described above, during the counterclockwise rotation (arrow direction A in FIG. 10) of the AC motor 60, the folding/stitching plate 43 is reciprocated between the standby position and the folding/stitching position. Further, the sheet lead-out member 48 is reciprocated between the standby position and the lead-out position. Moreover, while the folding/stitching plate 43 is in the standby position, the sheet lead-out member 48 is set in the lead-out position. While the folding/stitching plate 43 is in the folding/stitching position, the sheet lead-out member 48 is set in the standby position.

Figure 12:
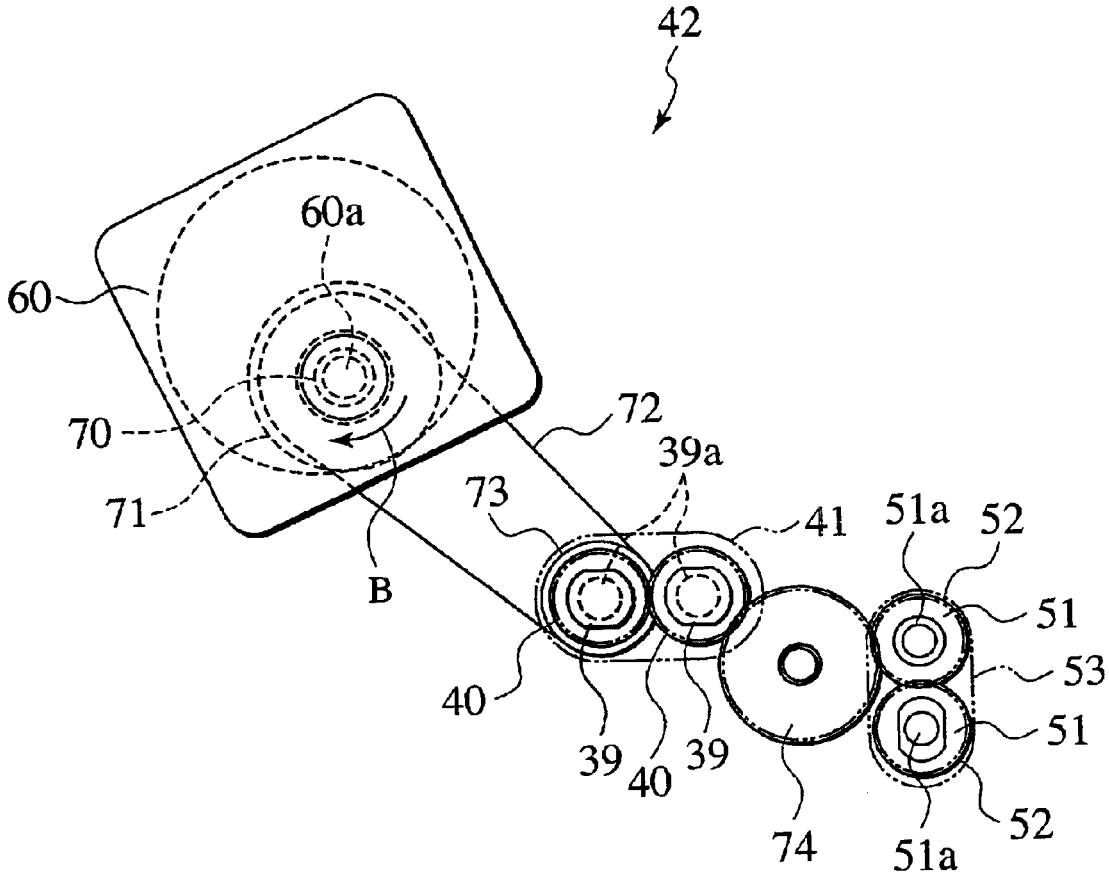
FIG. 12 is a front view showing main portions of a sheet discharge system of a folding/stitching unit according to the second embodiment.

As shown in FIGS. 12 and 13, the sheet discharge system of the folding/stitching drive unit 42 uses the AC motor 60, which is the only driving source of the folding/stitching apparatus 31, also as a driving source. On the outer peripheral surface of the rotary shaft 60*a* of the AC motor 60, a large-diameter pulley 71 is provided by interposing a second one-way clutch 70 therebetween. The second one-way clutch 70 transmits only rotation of a clockwise direction (arrow direction B in FIGS. 10 and 12, and similar thereinafter) of the AC motor 60 to the large-diameter pulley 71. Counterclockwise rotation of the AC motor 60 causes the large-diameter pulley 71 to run idle. One end of a timing belt 72 is placed on the large-diameter pulley 71. The other end of the timing belt 72 is placed on a small-diameter pulley 73. The small-diameter pulley 73 is fixed on the rod 39*a* of one introduction roller 39. Further, an idler gear 74 is engaged with the gear 40 fixed on the rod 39*a* of the other introduction roller 39. The idler gear 74 is engaged with a gear 52 of the rod 51*a* of one folding roller 51.

Both pairs of introduction rollers 39 and 39 and folding rollers 51 and 51 are rotary-driven in a direction for discharging the sandwiched sheets P2 during clockwise rotation (arrow direction B in FIG. 12) of the AC motor 60. Peripheral velocities of the pair of folding rollers 51 and 51 are set to be faster within 20% against those of the pair of introduction rollers 39 and 39.

Circuitry of the folding/stitching drive unit 42 will be now described based on FIGS. 17 to 21. As shown in FIGS. 17 to 21, the AC motor 60 includes a common terminal t1, a terminal t2 of a clockwise direction side, and a terminal t3 of a counterclockwise direction side. A capacitor C is interposed between the terminals t2 and t3 of the clockwise and counterclockwise direction sides. Power inputs to the terminals t2 and t3 of the clockwise and counterclockwise direction sides are varied, thereby switching rotational directions. A start switch SW1 and a motor reverse-rotation switch SW2 are interposed between the AC motor 60 and an AC power source 75. By the two switches SW1 and SW2, power inputs to the terminals t2 and t3 of the clockwise and counterclockwise direction sides are switched. The start switch SW1 is provided in the front plate 32*c* shown in FIG. 8. Further, the start switch SW1 is operated by the user. The start switch SW1 is pressed to a terminal t4 of a clockwise direction selection side by a built-in spring, whereby the start switch SW1 is switched to a terminal t5 of a counterclockwise direction side by a depressing operation of the user.

The motor reverse-rotation switch SW2 is provided in the case 32 shown in FIG. 9 or the like, and operated according to a position of the folding/stitching plate 43. The motor reverse-rotation switch SW2 is pressed to a terminal t6 of a counterclockwise direction selection side by a built-in spring. Moreover, in positions of the swing lever 66 corresponding to the standby position of the folding/stitching plate 43 and the vicinity thereof, the motor reverse-rotation switch SW2 is depressed by the swing lever 66 to be positioned in a terminal t7 of a clockwise direction selection side. In the position of the swing lever 66 other than the above-described position of the folding/stitching plate 43, the motor reverse-rotation switch SW2 is positioned in a terminal t6 of the counterclockwise direction selection side by a spring force of the built-in spring.

A folding/stitching operation of the folding/stitching apparatus 31 will be described by way of example, where sheets P1 of a predetermined size are folded and saddle-stitched precisely in a middle position. The position of the stopper member 36 is adjusted such that a precisely middle position of the sheets P1 can be aligned with that of the slit 38 when the sheets P1 of a predetermined size are loaded on the sheet setting tray 33 to be abutted on the stopper member 36.

Figure 17:
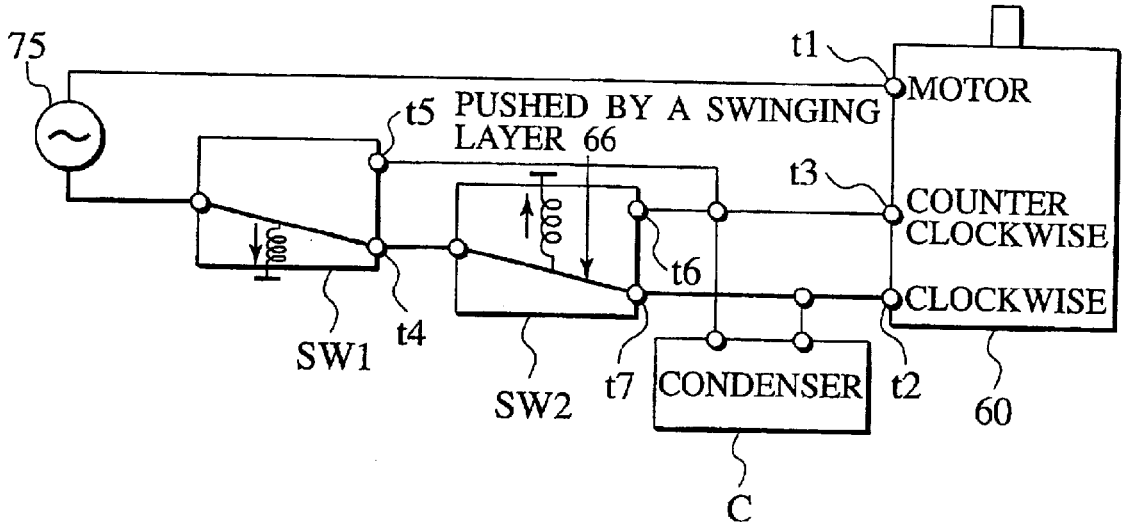
FIG. 17 is a circuit diagram of the folding/stitching drive unit showing a switch position in each step of a folding/stitching operation according to the second embodiment.

As shown in FIG. 17, when power is supplied to the folding/stitching apparatus 31, an AC current of the AC power source 75 is applied to the clockwise direction side terminal t2 of the AC motor 60, so that the AC motor 60 can be rotated in a clockwise direction. By the clockwise rotation of the AC motor 60, the pair of introduction rollers 39 and 39 and the pair of folding rollers 51 and 51 are rotary-driven in the sheet discharging direction. As shown in FIG. 9, a user inserts a plurality of superimposed sheets P1 on the sheet setting tray 33, and then insertion tip surfaces of the sheets P1 are set in a position for abutment on the stopper member 36.

Figure 18:
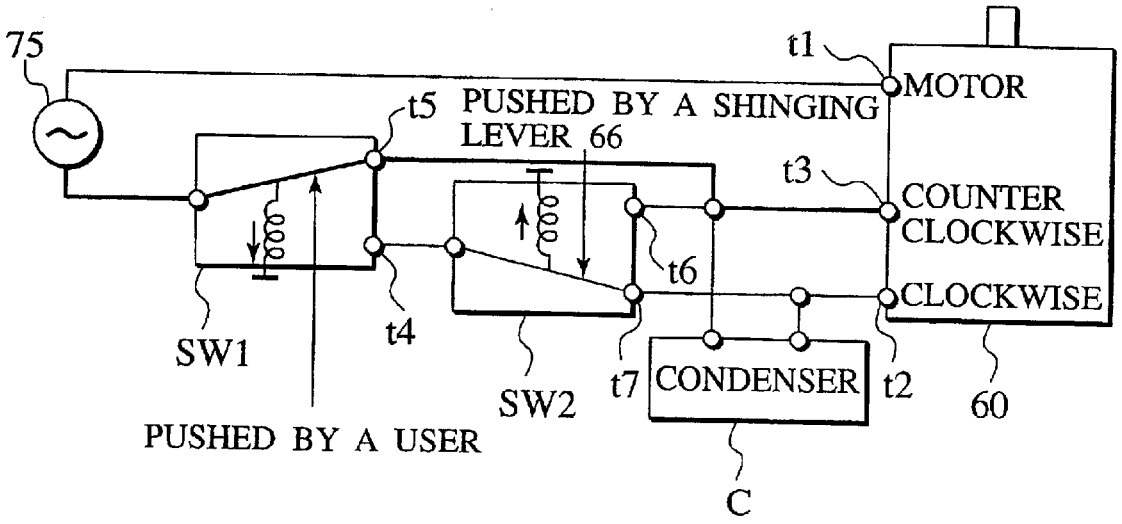
FIG. 18 is a circuit diagram of the folding/stitching drive unit showing a switch position in each step of a folding/stitching operation according to the second embodiment.

The user depresses the start switch SW1. Then, as shown in FIG. 18, a power input is switched to the counterclockwise direction side terminal t3 of the AC motor 60, thereby reversely rotating the AC motor 60 in the counterclockwise direction. By the counterclockwise rotation of the AC motor 60, the rotary-driving of the pair of introduction rollers 39 and 39 and the pair of folding rollers 51 and 51 is stopped. The folding/stitching plate 43 starts to move from the standby position to the folding/stitching position. Further, the sheet lead-out member 48 starts to move from the lead-out position to the standby position.

The folding/stitching plate 43 in the standby position is lowered from above the sheets P1, and abutted on the sheets P1. When the folding/stitching plate 43 is further lowered from such state, the sheets P1 are folded by the folding/stitching plate 43 in the abutting position, and inserted integrally with the folding/stitching plate 43 into the slit 38 of the sheet setting tray 33. By the lowering of the folding/stitching plate 43, the pair of introduction rollers 39 and 39 are following rotated in a direction for moving the sheets P1 integrally with the folding/stitching plate 43, and then the sheets P1 are smoothly inserted into the slit 38. The sheet lead-out member 48 is moved out from the lead-out position below the slit 38, so that the folding/stitching plate 43 and the sheets P1 accordingly inserted are permitted to be moved.

Figure 19:
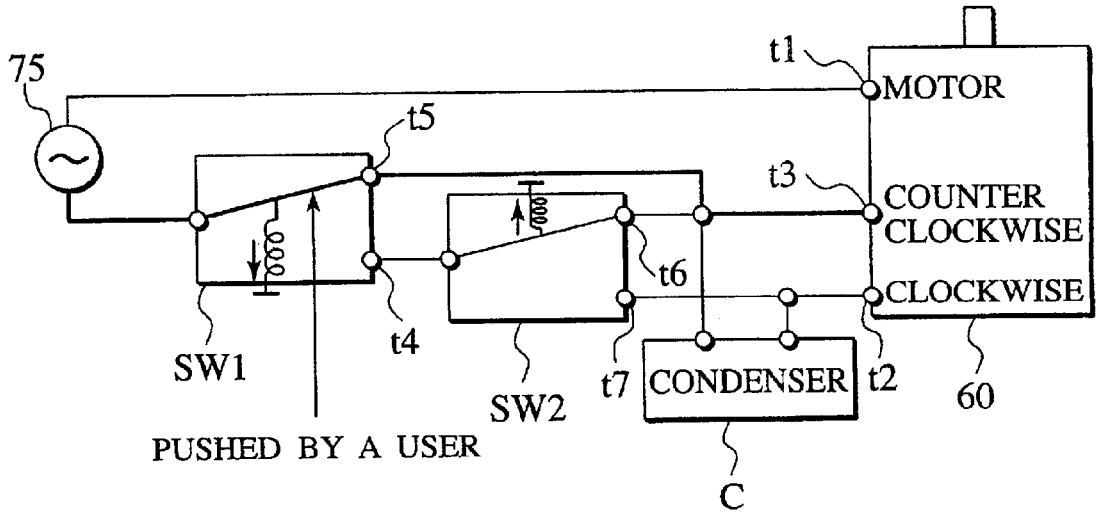
FIG. 19 is a circuit diagram of the folding/stitching drive unit showing a switch position in each step of a folding/stitching operation according to the second embodiment.
Figure 20:
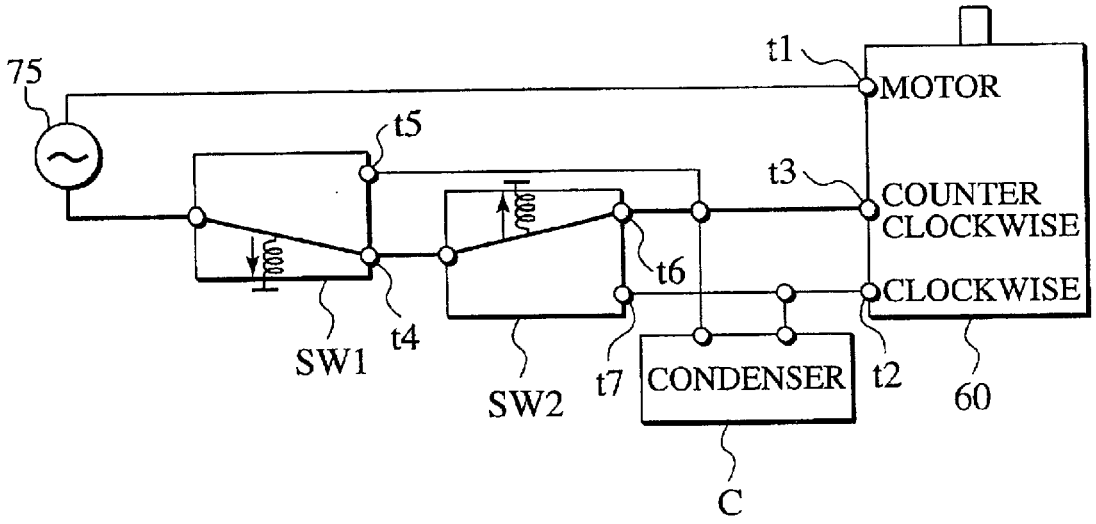
FIG. 20 is a circuit diagram of the folding/stitching drive unit showing a switch position in each step of a folding/stitching operation according to the second embodiment.

In the foregoing operation process, when the swing lever, 66 is slightly moved after the depression of the start switch SW1, as shown in FIGS. 19 and 20, the swing lever 66 no longer presses the motor reverse-rotation switch SW2. Accordingly, the motor reverse-rotation switch SW2 is switched to the counterclockwise direction selection side, and the AC motor 60 is continuously rotated in the counterclockwise direction even if the user releases the depression of the start switch SW1.

Figure 14:
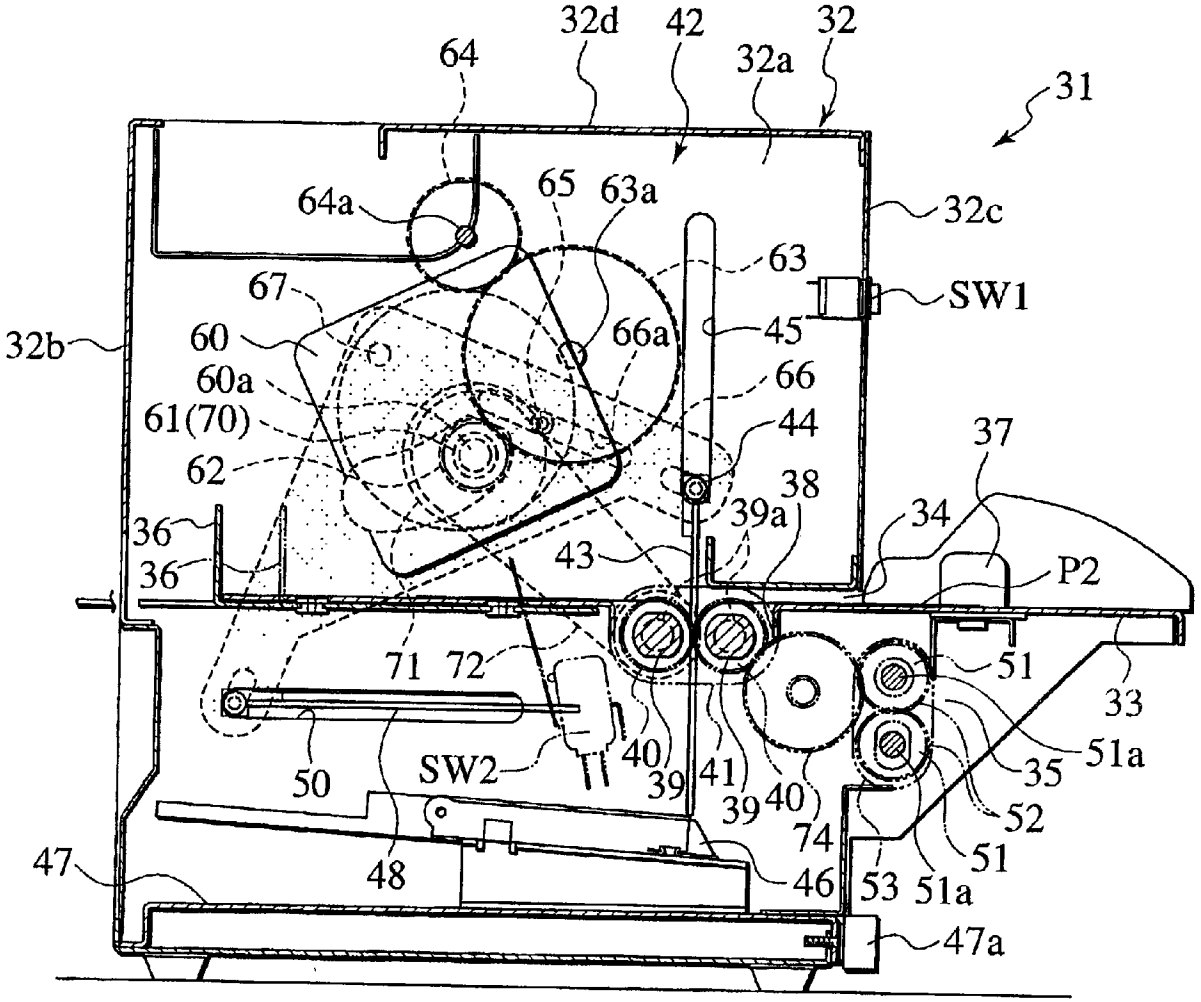
FIG. 14 is a schematic constitutional view of the folding/stitching apparatus having a folding/stitching plate set in a folding/stitching position according to the second embodiment.

As shown in FIG. 14, when the folding/stitching plate 43 is lowered to the folding/stitching position, the staple bending portions of the folding/stitching plate 43 are pressed into contact through the sheets P1 with the pair of staplers 46 and 46. By such press-contact force, each stapler 46 sticks staples, and then a tip of the staple 30 stuck into the sheets P1 is bent by each staple bending portion. Then, the plurality of superimposed sheets P1 become folded and saddle-stitched sheets P2.

Figure 15:
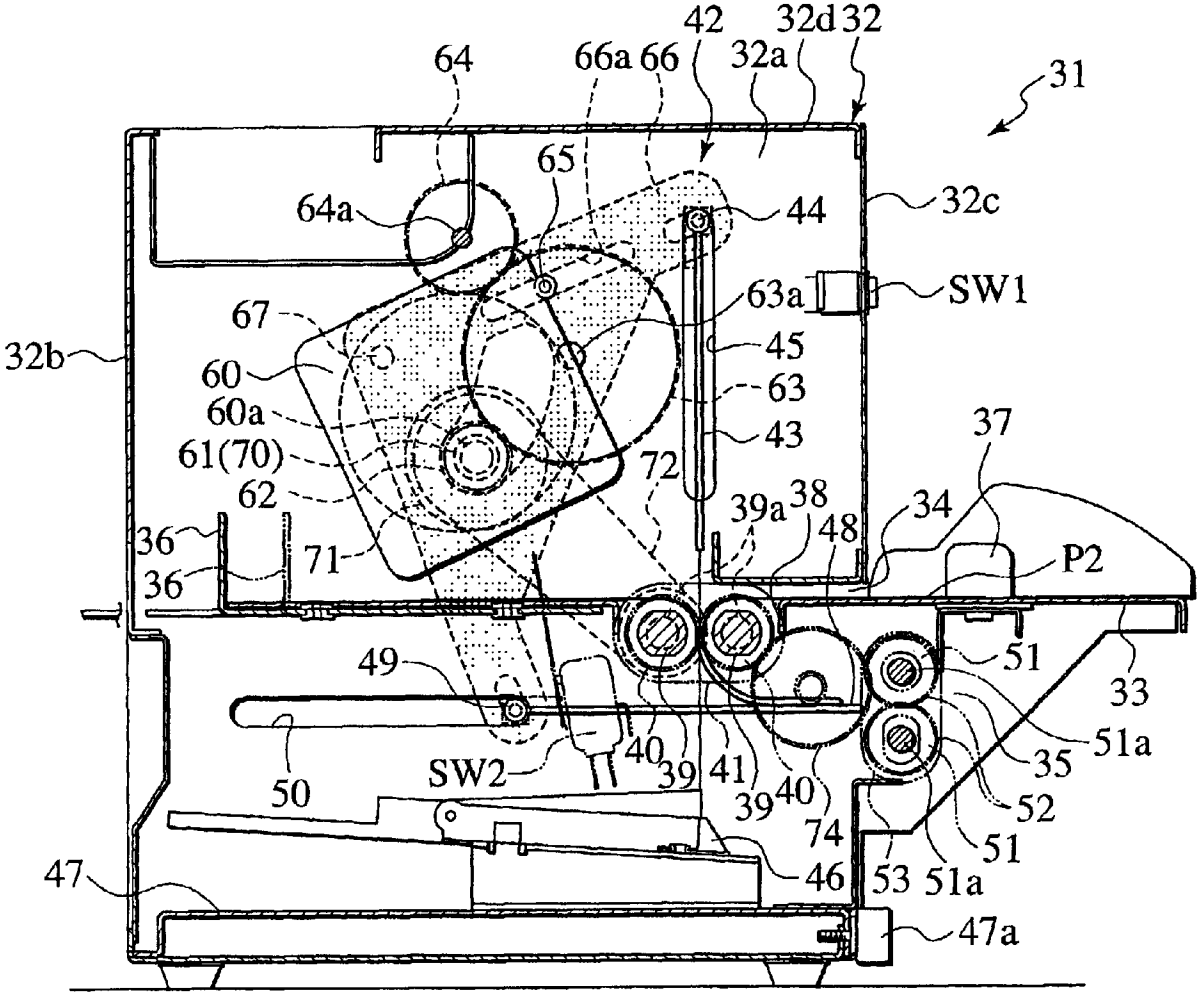
FIG. 15 is a schematic constitutional view of the folding/stitching apparatus in a state where the folding/stitching plate is being returned from the folding/stitching position to a standby position, and a sheet lead-out member is guiding folded and stitched sheets to a discharge side according to the second embodiment.

After the lowering of the folding/stitching plate 43 to the folding/stitching position, the folding/stitching plate 43 is raised. However, the pair of introduction rollers 39 and 39 are not rotated in conjunction with the movement of the folding/stitching plate 43 by the one way clutch. Thus, the folded and saddle-stitched sheets P2 are retained in the position without being raised integrally with the folding/stitching plate 43. As shown in FIG. 15, the folding/stitching plate 43 is raised to the standby position. The sheet lead-out member 48 is protruded from the standby position to the lead-out position, and the folded and saddle-stitched sheets P2 are guided to the side of the pair of folding rollers 51 and 51 in the discharging direction.

Figure 21:
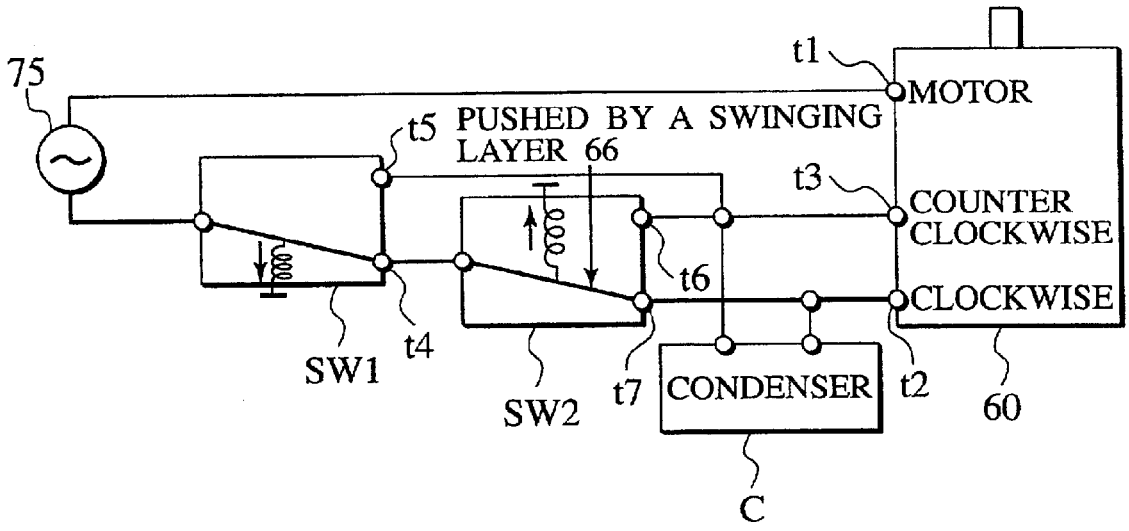
FIG. 21 is a circuit diagram of the folding/stitching drive unit showing a switch position in each step of a folding/stitching operation of the second embodiment.

In the foregoing operation process, as shown in FIG. 21, when the folding/stitching plate 43 is raised to the vicinity of the standby position, the swing lever 66 depresses the motor reverse-rotation switch SW2 again. Thus, a power input is switched to the clockwise direction side terminal t2 of the AC motor 60, thereby reversely rotating the AC motor 60. Therefore, while the folding/stitching plate 43 and the sheet lead-out member 48 are stopped respectively in the standby position and the lead-out position, the pair of introduction rollers 39 and 39 and the pair of folding rollers 51 and 51 are rotary-driven in the sheet discharging direction. Accordingly, the folded and saddle-stitched sheets P2 are passed between the pair of folding rollers 51 and 51, and then discharged.

In the folding/stitching apparatus 31, the sheets P1 are set on the sheet setting tray 33 such that the folding position can be aligned with that of the slit 38. The folding/stitching plate 43 is automatically moved from the standby position toward the folding/stitching position only by operating the start switch SW1. The sheets P1 are folded in the tip position of the folding/stitching plate 43 and inserted into the slit 38. When the folding/stitching plate 43 is moved to the folding/stitching position, staples are stuck into the sheets P1 by the stapler 46 in the tip position of the folding/stitching plate 43, and thus the folding position and the saddle-stitching position of the sheets P1 are naturally brought into agreement with each other. Therefore, it is not necessary to add any positioning units. Accordingly, it is possible to provide the folding/stitching apparatus 31 high in accuracy of the folding and saddle-stitching positions and simple in structure.

According to the second embodiment, the AC motor 60 is provided and, by the driving force of the AC motor 60, the folding/stitching plate 43 is moved between the standby position and the folding/stitching position. Thus, the driving force of the AC motor 43 enables folding/stitching work to be carried out. Accordingly, work of the user is reduced more compared with manual folding/stitching work, thereby reducing work mistakes and achieving a high processing speed. The operation of the folding/stitching plate 43 is stabilized more compared with the manual folding/stitching work, so that folding/stitching quality can be improved. A processing speed thereof is also high, and any instability is prevented.

According to the second embodiment, the pair of introduction rollers 39 and 39 and the pair of folding rollers 51 and 51 are constructed to be rotated by the driving force of the AC motor 60. Accordingly, the pair of introduction rollers 39 and 39 and the pair of folding rollers 51 and 51 are driven by the AC motor 60 for driving the folding/stitching plate 43, thereby reducing the number of mounted motors. According to the second embodiment, the folding/stitching apparatus 31 is manufactured by mounting only one AC motor 60.

Description will be made for a counter unit 80 additionally provided in the folding/stitching apparatus 31 of the second embodiment based on FIGS. 22 and 23.

Figure 22:
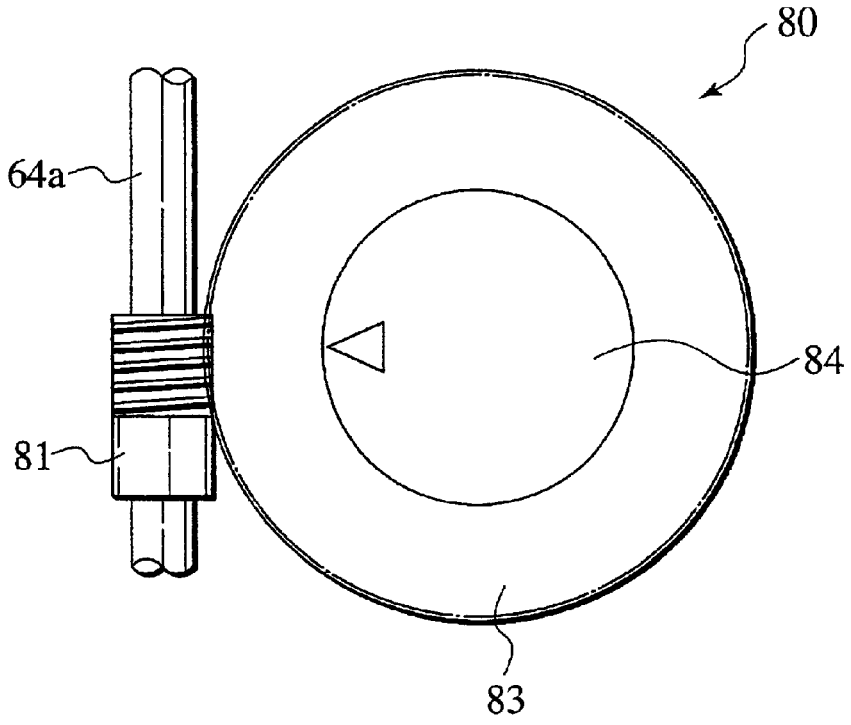
FIG. 22 is a plan view of a counter unit according to the second embodiment.
Figure 23:
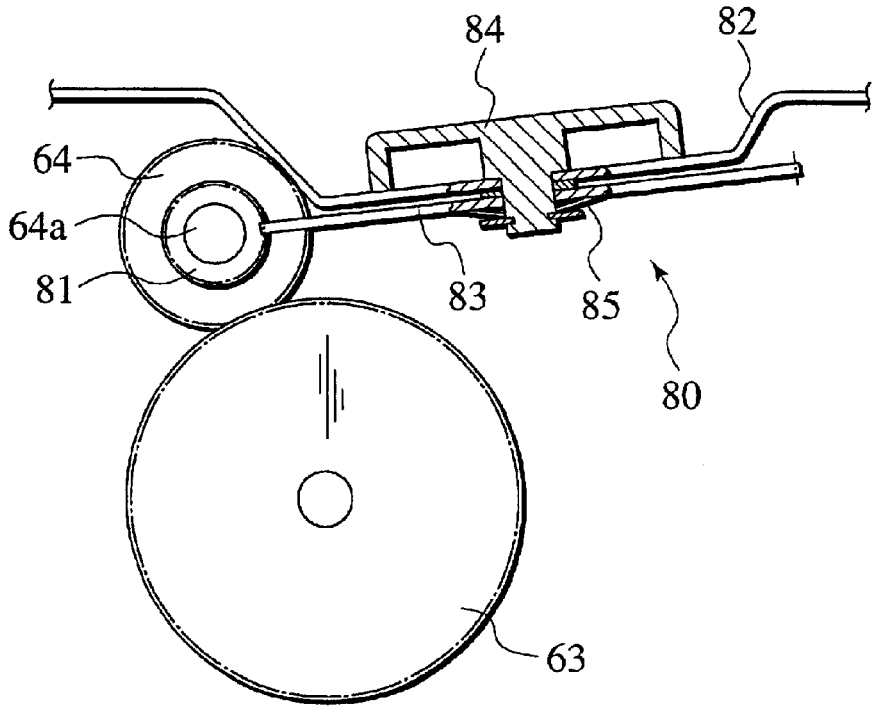
FIG. 23 is a front view showing the counter unit of the second embodiment.

As shown in FIGS. 22 and 23, the counter unit 80 indicates the numbers of remaining staples of the staplers 46 and 46. The counter unit 80 includes a worm gear 81 fixed on a support shaft 64*a*, a worm wheel 83 engaged with the worm gear 81 and rotatably supported on a support plate 82, a dial plate 84, which is coaxial to the worm wheel 83 and is rotated separately and independently, and a spring plate 85 for adhering the dial plate 84 and the worm wheel 83 to each other by a predetermined frictional force.

Scales are provided at predetermined intervals on an outer periphery of the dial plate 84. During rotation of the worm wheel 83, the dial plate 84 is rotated integrally by a spring force of the spring plate 85. A rotational angle of the worm wheel 83 is decided in proportion to the number of revolutions of the second gear 63. Accordingly, the dial plate 84 indicates the number of remaining staples by using such proportional relation.

The second gear 63 is rotated once by one staple sticking operation, and the third gear 64 is rotated by the number of revolutions decided by a gear ratio with the second gear 63. The numbers of revolutions are equal between the third gear 64 and the worm gear 81. The worm wheel 83 is advanced by one tooth per one revolution of the worm gear 81. Accordingly, the number of revolutions of the second gear 62 is proportional to a rotational angle of the worm wheel 83. Such proportional relation enables the number of remaining staples to be indicated. For example, assuming that the number of staples is 100, and the second and third gears have 60 and 30 teeth respectively, the number of teeth of the worm wheel 83 is set to 200 in order to rotate the worm wheel 83 precisely once when 100 staples are stuck.

By mounting the counter unit 80, the user can know when to replenish the staplers 46 and 46 with the staples 30 respectively before the staples 30 are finished up.

For using the staples 30 broken in the middle of staples connected to be integral or the staples 30 used partway in staples connected to be integral, the user sets the dial plate 84 in a rotational position corresponding to the number of connected staples. Accordingly, the number of remaining staples can be accurately indicated even when the staples 30 broken in the middle of the staples connected to be integral or the staples 30 used halfway in the staples connected to be integral are used.

Figure 24:
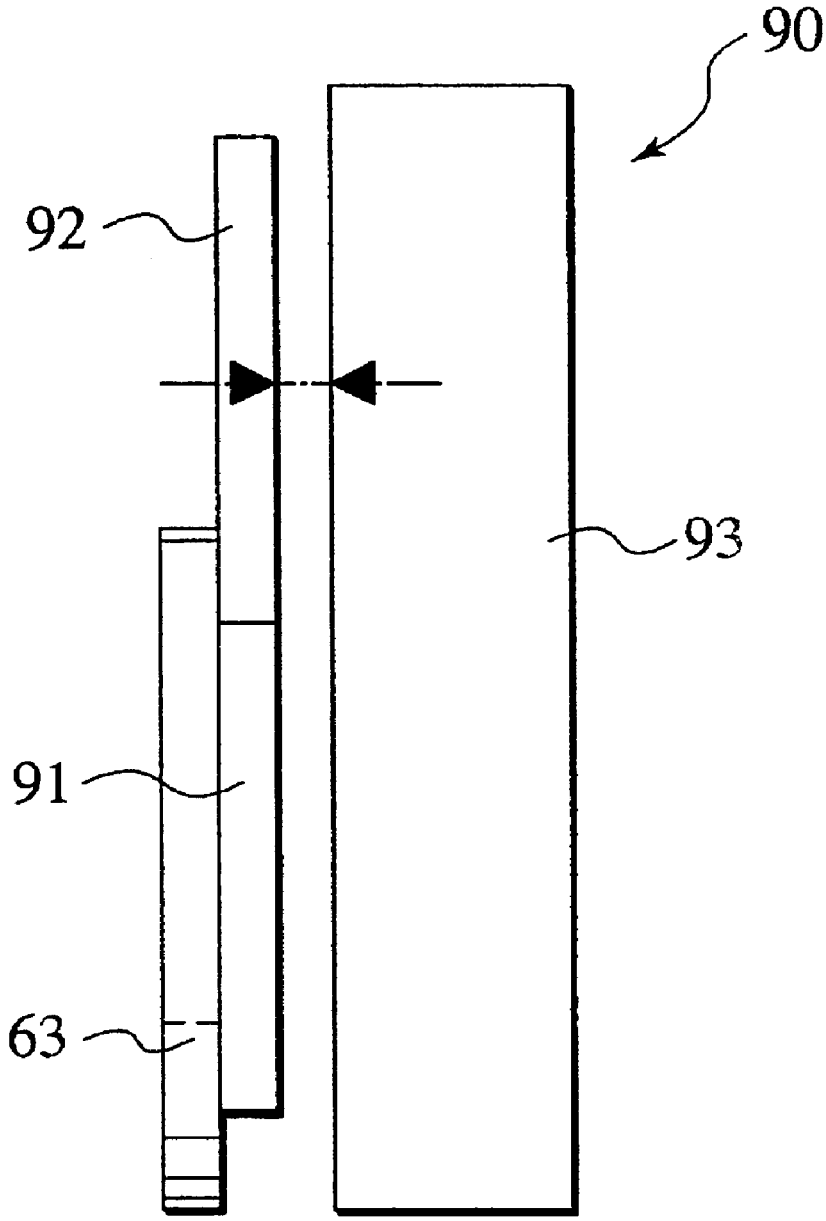
FIG. 24 is a schematic constitutional view showing a counter unit according to a modified example of the second embodiment.

FIG. 24 is a schematic constitutional view showing a modified example of a counter unit. As shown in FIG. 24, a counter unit 90 of the modified example includes a first counter gear 91, which is coaxial to the second gear 63 and is fixed by a predetermined frictional force, a second counter gear 92, which is engaged with the first counter gear 91 and has a mark (mark position indicated by an arrow), and a mark plate 93, which is disposed close to the second counter gear 92 and has a mark (mark position indicated by an arrow). The first counter gear 91 has the number of teeth set equal to the sum of 1 and the number of teeth N set in each stapler 46. The second counter gear 92 has the number of teeth set equal to the number of teeth N set in the stapler 46. By one folding/stitching operation, i.e., one staple sticking operation, the second counter gear 92 is rotated 1+1/N times. By performing the folding/stitching operation N times, i.e., the staple sticking operation N times, the second counter gear 92 is rotated N+1(=N/N) times. Thus, the described constitution enables the second counter gear 92 to be stopped when the mark position thereof is rotated precisely once, thereby indicating the number of remaining staples.

In the second embodiment, in order to assure the operation, the sheets P1 are set in the position for abutment on the stopper member 36, and then the user depresses the start switch SW1. However, if the start switch SW1 is mounted in the position, where the sheets P1 abuts on the stopper member 36, a process can be automatically started only by setting the sheets P1.

In the second embodiment, the AC motor 60 is used as a motor, and thus an electric system of the automatic folding/stitching apparatus 31 can be manufactured at low costs. Needless to say, however, members other than the AC motor 60 may be used for manufacturing the same.

The first and second embodiments have been described by way of example, where the sheets P1 are folded and saddle-stitched precisely in the middle position. However, the invention can be similarly applied to a case where the sheets P1 are folded and saddle-stitched in positions other than the precisely middle position. In the foregoing, the staplers 20 and 46 are respectively provided in the two places, and the staples 30 were stuck into the two places of the sheets P1. Needless to say, however, the numbers of staplers 20 and 46 may be one, three or more.

According to the first aspect of the present invention, the sheets are set on the sheet setting tray such that the folding position can be aligned with the slit position. When the folding/stitching plate is moved from the standby position toward the folding/stitching position, the sheets are folded in the tip position of the folding/stitching plate, and inserted into the slit. After the folding/stitching plate is moved to the folding/stitching position, staples are stuck into the sheets by the stapler in the tip position of the folding/stitching plate. Thus, the sheet folding/stitching positions are naturally brought into agreement with each other, removing the necessity of adding any positioning units. Therefore, accuracy of the folding/stitching positions is high, and the structure is simple.

According to the second aspect of the present invention, the folding/stitching operation can be performed by manually operating the handle, so that a structure thereof can be simplified more and costs can be reduced.

According to the third aspect of the present invention, the folding/stitching operation can be performed by the driving force of the motor. Thus, compared with the manual folding/stitching work, work of the user can be reduced more, thereby reducing mistakes and achieving a high processing speed. Further, compared with the manual folding/stitching work, the operation of the folding/stitching plate is stabilized more, thereby improving folding/stitching quality. Moreover, a higher processing speed can be achieved without any instability.

According to the fourth aspect of the present invention, in the process of the insertion of the plurality of sheets into the slit by the movement of the folding/stitching plate, the plurality of sheets are smoothly moved by the rotation of the pair of introduction rollers. Accordingly, the folding operation can be performed by preventing damage from being given to the sheets as much as possible.

According to the fifth aspect of the present invention, a space between the pair of introduction rollers is varied according to the total thickness of the plurality of sheets, and a predetermined sandwiching force is applied by the urging means. Therefore, sheets varied in total thickness can be folded.

According to the sixth aspect of the present invention, when the sheets are pressed and folded by the folding/stitching plate, the pair of introduction rollers integrally feed the sheets, such that the sheets can be folded smoothly.

According to the seventh aspect of the present invention, driving of the pair of introduction rollers needs not be performed separately, so that high usability can be provided.

According to the eight aspect of the present invention, the pair of introduction rollers are driven by the motor for driving the folding/stitching plate, whereby the number of motors to be mounted can be reduced.

According to the ninth aspect of the present invention, the folded and stitched sheets are discharged to the position for easy taking-out, thereby high usability can be provided for the user.

According to the tenth aspect of the present invention, the folded and stitched sheets are discharged to the position for easy taking-out, and folded well. Therefore, very high usability can be provided.

According to the eleventh aspect of the present invention, driving of the sheet lead-out member needs not be performed separately, so that high usability can be provided.

According to the twelfth aspect of the present invention, rotational driving of the pair of folding rollers need not be performed separately, whereby high usability can be provided.

According to the thirteenth aspect of the present invention, the pair of folding rollers is driven by the motor for driving the folding/stitching plate, or the motor for driving the pair of introduction rollers in addition. Accordingly, the number of motors to be mounted can be reduced.

While the preferred embodiments of the present invention have been described using specific terms, such description is for illustrative purposes. It is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention as defined in the following claims.

What is claimed is:

1. A folding/stitching apparatus comprising:

a sheet setting tray having an upper surface side where the slit is opened and sheets are set;

a folding/stitching plate provided to be freely moved between a standby position for not entering the slit of the sheet setting tray and a folding/stitching position for entering the slit, the folding/stitching plate having a staple bending portion provided in an insertion tip into the slit; and a stapler pressed into contact through the sheets with the folding/stitching plate set in a folding/stitching position to stick staples into the sheets.

2. The folding/stitching apparatus according to claim 1, further comprising:

a handle to be manually operated, wherein the folding/stitching plate is moved between the standby position and the folding/stitching position in conjunction with an operation of the handle.

3. The folding/stitching apparatus according to claim 1, still further comprising:

a motor, wherein the folding/stitching plate is moved between the standby position and the folding/stitching position by a driving force of the motor.

4. The folding/stitching apparatus according to claim 1, wherein a pair of introduction rollers is provided in the slit, and the folding/stitching plate is inserted integrally with the sheets between the pair of introduction rollers.

5. The folding/stitching apparatus according to claim 4, wherein the pair of introduction rollers is freely moved in both a contact direction with each other and a separate direction from each other, and pressed in the contact direction by an urging means.

6. The folding/stitching apparatus according to claim 4, wherein the folding/stitching plate is moved from the standby position to the folding/stitching position, and then the pair of introduction rollers is rotated in a direction for moving folded sheets integrally.

7. The folding/stitching apparatus according to claim 6, wherein the folding/stitching plate advances from the standby position to the folding/stitching position, and then the pair of introduction rollers is rotated in conjunction with the operation of the handle.

8. The folding/stitching apparatus according to claim 6, wherein the pair of introduction rollers is rotated by a driving force of the motor.

9. The folding/stitching apparatus according to claim 1, yet further comprising:

a sheet lead-out member, wherein the sheet lead-out member guides the folded and stitched sheets in a discharging direction when the folding/stitching plate is returned from the folding/stitching position to the standby position.

10. The folding/stitching apparatus according to claim 9, wherein a pair of folding rollers is provided at a position to which the sheets are guided by the sheet lead-out member, and the sheets being inserted between the folding rollers are moved in a discharging direction by rotation of the pair of folding rollers.

11. The folding/stitching apparatus according to claim 9, wherein the folding/stitching plate is returned from the folding/stitching position to the standby position, and then the sheet lead-out member is moved in conjunction with operations of both the handle and the folding/stitching plate.

12. The folding/stitching apparatus according to claim 10, wherein the pair of folding rollers is rotated in conjunction with an operation of the handle.

13. The folding/stitching apparatus according to claim 10, wherein the pair of folding rollers is rotated by the driving force of the motor.

* * * * *